US009303485B2

(12) United States Patent
Hecker et al.

(10) Patent No.: US 9,303,485 B2
(45) Date of Patent: Apr. 5, 2016

(54) WELLBORE APPARATUS AND METHODS FOR ZONAL ISOLATIONS AND FLOW CONTROL

(75) Inventors: Michael T. Hecker, Tomball, TX (US); Michael D. Barry, The Woodlands, TX (US); Petrus A. J. Stevens, Brighton East (AU); David A. Howell, Houston, TX (US); Charles S. Yeh, Spring, TX (US); Iain M. Macleod, Newmachar (GB); Lee Mercer, Kintore (GB); Stephen Reid, Aberdeenshire (GB); Andrew J. Elrick, Mintlaw Peterhead (GB)

(73) Assignee: ExxonMobil Upstream Research Company, Houston, TX (US)

( * ) Notice: Subject to any disclaimer, the term of this patent is extended or adjusted under 35 U.S.C. 154(b) by 400 days.

(21) Appl. No.: 13/990,803

(22) PCT Filed: Dec. 6, 2011

(86) PCT No.: PCT/US2011/063356

§ 371 (c)(1),
(2), (4) Date: May 31, 2013

(87) PCT Pub. No.: WO2012/082447

PCT Pub. Date: Jun. 21, 2012

(65) Prior Publication Data

US 2013/0248178 A1 Sep. 26, 2013

Related U.S. Application Data

(60) Provisional application No. 61/424,427, filed on Dec. 17, 2010, provisional application No. 61/482,788, filed on May 5, 2011, provisional application No. 61/561,116, filed on Nov. 17, 2011.

(51) Int. Cl.

| | |
|---|---|
| ***E21B 33/13*** | (2006.01) |
| ***E21B 33/12*** | (2006.01) |
| ***E21B 43/04*** | (2006.01) |

(52) U.S. Cl.
CPC ..... *E21B 33/13* (2013.01); *E21B 33/12* (2013.01); *E21B 43/045* (2013.01)

(58) Field of Classification Search
CPC ..... E21B 43/02; E21B 43/04; E21B 43/08; E21B 43/10; E21B 43/14
See application file for complete search history.

(56) References Cited

U.S. PATENT DOCUMENTS

| | | | |
|---|---|---|---|
| 4,945,991 | A | 8/1990 | Jones |
| 5,113,935 | A | 5/1992 | Jones et al. |

(Continued)

OTHER PUBLICATIONS

Barry, M. D., et al., (2007), "Openhole Gravel Packing with Zonal Isolation," SPE-110460, *SPE Annual Technical Conference and Exhibition*, pp. 1-10.

Hecker, M. T., et al., (2004), "Reducing Well Cost by Gravel Packing in Nonaqueous Fluid," SPE-90758, *SPE AnnualTechnical Conference and Exhibition*, pp. 1-7.

(Continued)

*Primary Examiner* — Steven MacDonald
(74) *Attorney, Agent, or Firm* — ExxonMobil Upstream Research-Law Department

(57) ABSTRACT

Method for completing a wellbore in a subsurface formation includes providing a sand control device representing one or more joints of sand screens, and a packer assembly along the joints with at least one mechanically-set packer with at least one alternate flow channel therein. Running the packer assembly and connected sand screen into the wellbore, setting a mechanically-set packer into engagement with the surrounding wellbore, injecting gravel slurry into the wellbore to form a gravel pack. An elongated isolation string is run into the sand control device across the packer assembly with valves that serve as an inflow control device. Thereafter, seals are activated around the isolation string and adjacent the packer assembly. A zonal isolation apparatus allows flow control to be provided above and below packer assembly.

40 Claims, 17 Drawing Sheets

(56) References Cited

U.S. PATENT DOCUMENTS 5,348,091 A 9/1994 Tchakarov et al.
5,390,966 A 2/1995 Cox et al.
5,396,954 A 3/1995 Brooks
5,476,143 A 12/1995 Sparlin et al.
5,588,487 A 12/1996 Bryant
5,636,689 A 6/1997 Rubbo et al.
5,868,200 A 2/1999 Bryant et al.
5,887,660 A 3/1999 Yokley et al.
5,909,774 A 6/1999 Griffith et al.
5,975,205 A 11/1999 Carisella
6,003,834 A 12/1999 Read
6,179,056 B1 1/2001 Smith
6,298,916 B1 10/2001 Tibbles et al.
6,325,144 B1 12/2001 Turley et al.
6,354,378 B1 3/2002 Patel
6,405,800 B1 * 6/2002 Walker ..... E21B 43/08 166/235
6,409,219 B1 6/2002 Broome et al.
6,464,261 B1 10/2002 Dybevik et al.
6,513,599 B1 2/2003 Bixenman et al.
6,516,881 B2 2/2003 Hailey, Jr.
6,520,254 B2 2/2003 Hurst et al.
6,557,634 B2 5/2003 Hailey, Jr. et al.
6,575,251 B2 6/2003 Watson et al.
6,581,689 B2 6/2003 Hailey, Jr.
6,601,646 B2 8/2003 Streich et al.
6,644,404 B2 11/2003 Schultz et al.
6,666,274 B2 12/2003 Hughes
6,695,067 B2 2/2004 Johnson et al.
6,705,402 B2 3/2004 Proctor
6,749,023 B2 6/2004 Nguyen et al.
6,749,024 B2 6/2004 Bixenman
6,752,206 B2 6/2004 Watson et al.
6,752,207 B2 6/2004 Danos et al.
6,755,245 B2 6/2004 Nguyen et al.
6,789,621 B2 9/2004 Wetzel et al.
6,789,623 B2 9/2004 Hill, Jr. et al.
6,789,624 B2 9/2004 McGregor et al.
6,814,139 B2 11/2004 Hejl et al.
6,817,410 B2 11/2004 Wetzel et al.
6,830,104 B2 12/2004 Nguyen et al.
6,883,608 B2 4/2005 Parlar et al.
6,923,262 B2 8/2005 Broome et al.
6,935,432 B2 8/2005 Nguyen
6,983,796 B2 1/2006 Bayne et al.
6,986,390 B2 1/2006 Doane et al.
6,997,263 B2 2/2006 Campbell et al.
7,044,231 B2 5/2006 Doane et al.
7,048,061 B2 5/2006 Bode et al.
7,051,805 B2 5/2006 Doane et al.
7,055,598 B2 6/2006 Ross et al.
7,096,945 B2 8/2006 Richards et al.
7,100,691 B2 9/2006 Nguyen et al.
7,104,324 B2 9/2006 Wetzel et al.
7,147,054 B2 12/2006 Wang et al.
7,152,677 B2 12/2006 Parlar et al.
7,207,383 B2 4/2007 Hurst et al.
7,222,676 B2 5/2007 Patel et al.
7,243,715 B2 7/2007 Wang et al.
7,243,723 B2 7/2007 Surjaatmadja et al.
7,243,724 B2 7/2007 McGregor et al.
7,243,732 B2 7/2007 Richard
7,252,142 B2 8/2007 Brezinski et al.
7,264,061 B2 9/2007 Dybevik et al.
7,278,479 B2 10/2007 Kvernstuen et al.
7,343,983 B2 3/2008 Livingstone
7,363,974 B2 4/2008 Wang et al.
7,367,395 B2 5/2008 Vidrine et al.
7,370,700 B2 5/2008 Hurst et al.
7,373,978 B2 5/2008 Barry et al.
7,392,852 B2 7/2008 Richard
7,407,007 B2 8/2008 Tibbles
7,426,962 B2 9/2008 Moen et al.
7,431,058 B2 10/2008 Holting
7,431,085 B2 10/2008 Coronado et al.
7,431,091 B2 10/2008 Themig et al.
7,431,098 B2 10/2008 Ohmer et al.
7,441,605 B2 10/2008 Coronado et al.
7,493,959 B2 2/2009 Johnson et al.
7,497,267 B2 3/2009 Setterberg, Jr. et al.
7,562,709 B2 7/2009 Saebi et al.
7,584,799 B2 9/2009 Coronado et al.
7,591,321 B2 9/2009 Whitsitt et al.
7,597,141 B2 10/2009 Rouse et al.
7,624,810 B2 12/2009 Fould et al.
7,661,476 B2 2/2010 Yeh et al.
7,681,652 B2 3/2010 Gaudette et al.
7,735,559 B2 6/2010 Malone
7,828,056 B2 11/2010 Dybevik et al.
7,832,472 B2 11/2010 Themig
7,886,819 B2 2/2011 Setterberg, Jr. et al.
7,938,184 B2 5/2011 Yeh et al.
7,971,642 B2 7/2011 Yeh et al.
8,215,406 B2 7/2012 Dale et al.
2003/0127227 A1 7/2003 Fehr et al.
2003/0173075 A1 9/2003 Morvant et al.
2004/0007829 A1 1/2004 Ross
2004/0140089 A1 7/2004 Gunneroed
2005/0028977 A1 2/2005 Ward
2005/0039917 A1 2/2005 Hailey, Jr.
2005/0061501 A1 3/2005 Ward et al.
2005/0082060 A1 4/2005 Ward et al.
2005/0241855 A1 11/2005 Wylie et al.
2005/0263287 A1 12/2005 Achee, Jr. et al.
2006/0231253 A1 * 10/2006 Vilela ..... E21B 37/08 166/278
2007/0056750 A1 3/2007 John et al.
2008/0125335 A1 5/2008 Bhavsar
2008/0128126 A1 6/2008 Dagenais et al.
2008/0128129 A1 * 6/2008 Yeh ..... E21B 17/02 166/275
2008/0142222 A1 6/2008 Howard et al.
2008/0142227 A1 * 6/2008 Yeh ..... E21B 17/02 166/369
2008/0314589 A1 12/2008 Guignard et al.
2009/0008084 A1 1/2009 Dybevik et al.
2009/0008092 A1 * 1/2009 Haeberle ..... E21B 33/12 166/278
2009/0084556 A1 4/2009 Richards et al.
2009/0159279 A1 6/2009 Assal
2009/0159298 A1 6/2009 Assal
2009/0283279 A1 11/2009 Patel et al.
2009/0294128 A1 * 12/2009 Dale ..... E21B 43/04 166/306
2009/0308592 A1 12/2009 Mercer et al.
2010/0032158 A1 2/2010 Dale et al.
2010/0065284 A1 3/2010 Freyer
2010/0096119 A1 4/2010 Sevre et al.
2010/0147538 A1 6/2010 Gaudette et al.
2010/0155064 A1 6/2010 Nutley et al.
2010/0175894 A1 * 7/2010 Debard ..... E21B 43/08 166/382
2010/0200243 A1 * 8/2010 Purkis ..... E21B 34/06 166/373
2010/0218948 A1 9/2010 Mickelburgh et al.
2010/0252252 A1 10/2010 Harris et al.
2011/0042106 A1 2/2011 MacLeod
2011/0284208 A1 11/2011 MacLeod et al.
2012/0018153 A1 1/2012 Yeh et al.

OTHER PUBLICATIONS

Hecker, M. T., et al., (2010), Extending Openhole Gravel Packing Capability: Initial Field Installation of Internal Shunt Alternate Path Technology, SPE-135102, *SPE AnnualTechnical Conference and Exhibition*, pp. 1-6.

Hurst, G., et al., (2004), "Alternate Path Completions: A Critical Review and Lessons Learned From Case Histories With Recommended Practices for Deepwater Applications", SPE-86532, *SPE Internatinal Symposium and Exhibition*, pp. 1-14.

* cited by examiner

WELLBORE APPARATUS AND METHODS FOR ZONAL ISOLATIONS AND FLOW CONTROL

CROSS REFERENCE TO RELATED APPLICATIONS

This application is the National Stage of International Application No. PCT/US11/63356, filed 6 Dec. 2011, which claims the benefit of U.S. Provisional Application No. 61/424,427, filed 17 Dec. 2010; U.S. Provisional Application No. 61/482,788, filed 5 May 2011; and U.S. Provisional Application No. 61/561,116, filed 17 Nov. 2011.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

1. Field of the Invention

The present disclosure relates to the field of well completions. More specifically, the present invention relates to the isolation of formations in connection with wellbores that have been completed using gravel-packing. The application also relates to a zonal isolation apparatus that may be set within either a cased hole or an open-hole wellbore and which incorporates alternate flow channel technology.

2. Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of the formation behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A production string or "tubing" is then positioned inside the wellbore extending down below the last string of casing and across a subsurface formation.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of gravel packs eliminates the need for cementing, perforating, and post-perforation clean-up operations.

A common problem in open-hole completions is the immediate exposure of the wellbore to the surrounding formation. If the formation is unconsolidated or heavily sandy, the flow of production fluids into the wellbore may carry with it formation particles, e.g., sand and fines. Such particles can be erosive to production equipment downhole and to pipes, valves and separation equipment at the surface.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slots or openings. The base pipe is then typically wrapped with a filtration medium such as a wire wrap or wire mesh.

To augment sand control devices, particularly in open-hole completions, it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together forms a gravel slurry. The slurry dries in place, leaving a circumferential packing of gravel. The gravel not only aids in particle filtration but also helps maintain formation integrity.

In an open-hole gravel pack completion, the gravel is positioned between a sand screen that surrounds a perforated base pipe and a surrounding wall of the wellbore. During production, formation fluids flow from the subterranean formation, through the gravel, through the screen, and into the inner base pipe. The base pipe thus serves as a part of the production string.

A problem historically encountered with gravel-packing is that an inadvertent loss of carrier fluid from the slurry during the delivery process can result in premature sand or gravel bridges being formed at various locations along open-hole intervals. For example, in an interval having high permeability or in an interval that has been fractured, a poor distribution of gravel may occur due to a premature loss of carrier fluid from the gravel slurry into the formation. Premature sand bridging can block the flow of gravel slurry, causing voids to form along the completion interval. Similarly, a packer for zonal isolation in the annulus between screen and wellbore can also block the flow of gravel slurry, causing voids to form along the completion interval. Thus, a complete gravel-pack from bottom to top is not achieved, leaving the wellbore exposed to sand and fines infiltration.

The problems of sand bridging and of bypassing zonal isolation have been addressed through the use of Alternate Path Technology®. Alternate Path Technology® employs shunt tubes or flow channels that allow the gravel slurry to bypass selected areas, e.g., premature sand bridges or packers, along a wellbore. Such fluid bypass technology is described, for example, in U.S. Pat. No. 5,588,487 entitled "Tool for Blocking Axial Flow in Gravel-Packed Well Annulus," and PCT Publication No. WO2008/060479 entitled "Wellbore Method and Apparatus for Completion, Production, and Injection," each of which is incorporated herein by reference in its entirety. Additional references which discuss alternate flow channel technology include U.S. Pat. Nos. 8,011,437; 7,971,642; 7,938,184; 7,661,476; 5,113,935; 4,945,991; U.S. Pat. Publ. No. 2010/0032158; U.S. Pat. Publ. No. 2009/0294128; M. T. Hecker, et al., "Extending Open-hole Gravel-Packing Capability: Initial Field Installation of Internal Shunt Alternate Path Technology," SPE Annual Technical Conference and Exhibition, SPE Paper No. 135, 102 (September 2010); and M. D. Barry, et al., "Open-hole Gravel Packing with Zonal Isolation," SPE Paper No. 110, 460 (November 2007).

The efficacy of a gravel pack in controlling the influx of sand and fines into a wellbore is well-known. However, it is also sometimes desirable with open-hole completions to isolate selected intervals along the open-hole portion of a wellbore in order to control the inflow of fluids. For example, in connection with the production of condensable hydrocarbons, water may sometimes invade an interval. This may be due to the presence of native water zones, coning (rise of near-well hydrocarbon-water contact), high permeability streaks, natural fractures, or fingering from injection wells. Depending on the mechanism or cause of the water production, the water may be produced at different locations and times during a well's lifetime. Similarly, a gas cap above an oil reservoir may expand and break through, causing gas production with oil. The gas breakthrough reduces gas cap drive and suppresses oil production.

In these and other instances, it is desirable to isolate an interval from the production of formation fluids into the wellbore. Annular zonal isolation may also be desired for production allocation, production/injection fluid profile control, selective stimulation, or gas control. However, the design and installation of open-hole packers is highly problematic due to under-reamed areas, areas of washout, higher pressure differentials, frequent pressure cycling, and irregular borehole sizes. In addition, the longevity of zonal isolation is a consideration as the water/gas coning potential often increases later in the life of a field due to pressure drawdown and depletion.

Therefore, a need exists for an improved sand control system that provides fluid bypass technology for the placement of gravel that bypasses a packer. A need further exists for a packer assembly that provides isolation of selected subsurface intervals along an open-hole wellbore. Further, a need exists for a wellbore apparatus that enables zonal isolation and flow control along a gravel pack within a wellbore.

SUMMARY OF THE INVENTION

A gravel pack zonal isolation apparatus for a wellbore is first provided herein. The zonal isolation apparatus has particular utility in connection with the placement of a gravel pack within an open-hole portion of the wellbore. The open-hole portion extends through one, two, or more subsurface intervals.

In one embodiment, the zonal isolation apparatus first includes a string of tubing. The string of tubing resides within a wellbore and is configured to receive fluids. The fluids may be production fluids that have been produced from the one or more subsurface intervals. Alternatively, the fluids may be water or other injection fluids being injected into the one or more subsurface intervals.

The zonal isolation apparatus also includes a sand control device. The sand control device includes an elongated base pipe. The base pipe defines a tubular member having a first end and a second end. The zonal isolation apparatus further comprises a filter medium surrounding the base pipe along a substantial portion of the base pipe. Together, the base pipe and the filter medium form a sand screen.

The sand screen is arranged to have alternate flow path technology. In this respect, the sand screen includes at least one alternate flow channel to bypass the base pipe. The channels extend along the base pipe substantially from the first end to the second end.

The zonal isolation apparatus also includes at least one and, optionally, at least two packer assemblies. Each packer assembly includes a mechanically-set packer that serves as a seal. More preferably, each packer assembly has two mechanically-set packers or annular seals. These represent an upper packer and a lower packer. Each mechanically-set packer has a sealing element that may be, for example, from about 6 inches (15.2 cm) to 24 inches (61.0 cm) in length. Each mechanically-set packer also has an inner mandrel in fluid communication with the base pipe of the sand screen.

Intermediate the at least two mechanically-set packers may optionally be at least one swellable packer element. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

The swellable packer element preferably swells in the presence of an aqueous fluid. In one aspect, the swellable packer element may include an elastomeric material that swells in the presence of hydrocarbon liquids or an actuating chemical. This may be in lieu of or in addition to an elastomeric material that swells in the presence of an aqueous fluid.

As part of the alternate flow path technology, the zonal isolation apparatus also includes one or more alternate flow channels extending through and along the various packer elements within each packer assembly. The alternate flow channels serve to divert gravel pack slurry from an upper interval to one or more lower intervals during a gravel packing operation.

In one aspect, the first and second mechanically-set packers are uniquely designed to be set within the wellbore before a gravel packing operation begins. The downhole packer seals an annular region between the mandrel and a surrounding wellbore. The wellbore has preferably been completed as an open hole wellbore. Alternatively, the wellbore may be completed with a cased hole, meaning that a string of production casing has been perforated. Alternatively, the wellbore may be completed with a joint of blank pipe, and a mechanically-set packer is set along the joint of blank pipe.

The zonal isolation apparatus also includes an elongated isolation string. The isolation string comprises a tubular body. The tubular body has an inner diameter defining a bore that is in fluid communication with the string of tubing. The tubular body also has an outer diameter configured to reside within the base pipe of the screen and the mandrel of the packer assemblies.

The zonal isolation apparatus further includes a first valve. The first valve is placed above or below the packer assembly. The first valve defines at least one port that may be opened and closed (or any position in between) in order to selectively place the bore of the tubular body in fluid communication with a bore of the surrounding base pipe.

The zonal isolation apparatus further includes one or more seals. A seal could be a packer. The seals reside along the outer diameter of the tubular body. The isolation string is placed so that the seals are adjacent to the packer assembly. When activated, the seals serve to seal an annular region formed between the outer diameter of the tubular body and the surrounding mandrel of a set packer assembly.

Preferably, the zonal isolation apparatus also includes a second valve. In this instance, either the first valve or the second valve is above the first packer assembly, and the other of the first valve and the second valve is below the first packer assembly.

In one embodiment, the at least one port in the first valve comprises two or more through-openings through the tubular body, and the second valve also comprises two or more through-openings through the tubular body. In this instance, the first valve and the second valve may each be configured so that at least one of the two or more through-openings may be selectively closed, thereby partially restricting the flow of fluids through the tubular body. In this way, a true in-flow control device is provided.

In one embodiment, the zonal isolation apparatus comprise an upper seal and a lower seal. The upper seal and the lower seal are spaced apart along the joints of base pipe so as to straddle a selected subsurface interval within a wellbore. In this embodiment, the isolation string may further comprise a third valve. In this instance, the first valve may be above the first packer assembly, the second valve is intermediate the first and second packer assemblies, and the third valve is below the second packer assembly.

A method for completing a wellbore in a subsurface formation is also provided herein. The wellbore preferably includes a lower portion completed as an open-hole. In one aspect, the method includes providing a sand control device. The sand control device is in accordance with the sand control device described above.

The method also includes providing a packer assembly. The packer assembly is also in accordance with the packer assembly described above in its various embodiments. The packer assembly includes at least one, and preferably two, mechanically-set packers. For example, each packer will have an inner mandrel, alternate flow channels around the inner mandrel, and a sealing element external to the inner mandrel.

The method also includes connecting the packer assembly to the sand screen intermediate two joints of the base pipe. The method then includes running the packer assembly and connected sand screen into the wellbore. The packer and connected sand screen are placed along the open-hole portion (or other production interval) of the wellbore.

The method also includes setting the at least one mechanically-set packer. This is done by actuating the sealing element of the packer into engagement with the surrounding open-hole portion of the wellbore. Thereafter, the method includes injecting a gravel slurry into an annular region formed between the sand screen and the surrounding open-hole portion of the wellbore, and then further injecting the gravel slurry through the alternate flow channels to allow the gravel slurry to bypass the packer. In this way, the open-hole portion of the wellbore is gravel-packed above and below the packer after the packer has been set in the wellbore.

In the method, it is preferred that the packer assembly also include a second mechanically-set packer. The second mechanically-set packer is constructed in accordance with the first mechanically-set packer, or is a mirror image thereof. A swellable packer may then optionally be provided intermediate the first and second mechanically-set packers. The swellable packer has alternate flow channels aligned with the alternate flow channels of the first and second mechanically-set packers. Alternatively, the packer assembly may include a gravel-based zonal isolation tool intermediate the first and second packers.

The method also includes running a string of tubing into the wellbore with an elongated isolation string connected at a lower end of the string of tubing. The isolation string comprises:

- a tubular body having an inner diameter defining a bore in fluid communication with a bore of the string of tubing, and an outer diameter configured to reside within the base pipe of the sand control device and within the inner mandrel of the packer assembly,
- a first valve, and
- one or more seals along the outer diameter of the tubular body.

The method then includes placing the elongated isolation string within the base pipe and across the packer assembly. In this way, the first valve of the isolation string is above or below the packer assembly, and the seals of the isolation string are adjacent to the set packer assembly.

The method further includes activating the seals in order to seal an annular region formed between the outer diameter of the tubular body and the surrounding mandrel adjacent to the set packer assembly.

It is preferred that the first valve comprise two or more through-openings through the tubular body. In this instance, the method further includes closing at least one of the two or more through-openings, thereby partially restricting the flow of fluids through the tubular body. It is also preferred that the isolation string include a second valve. In this instance, either the first valve or the second valve is above the packer, and the other of the first valve and the second valve is below the packer. In this instance, the method further includes closing the first valve, the second valve, or both, or alternatively, opening the first valve, the second valve, or both, thereby creating fluid communication between the selected valve and a bore of the base pipe.

The method may also include producing hydrocarbon fluids from at least one interval along the open-hole portion of the wellbore. Alternatively, the method may also include injecting fluids into at least one interval along the open-hole portion of the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
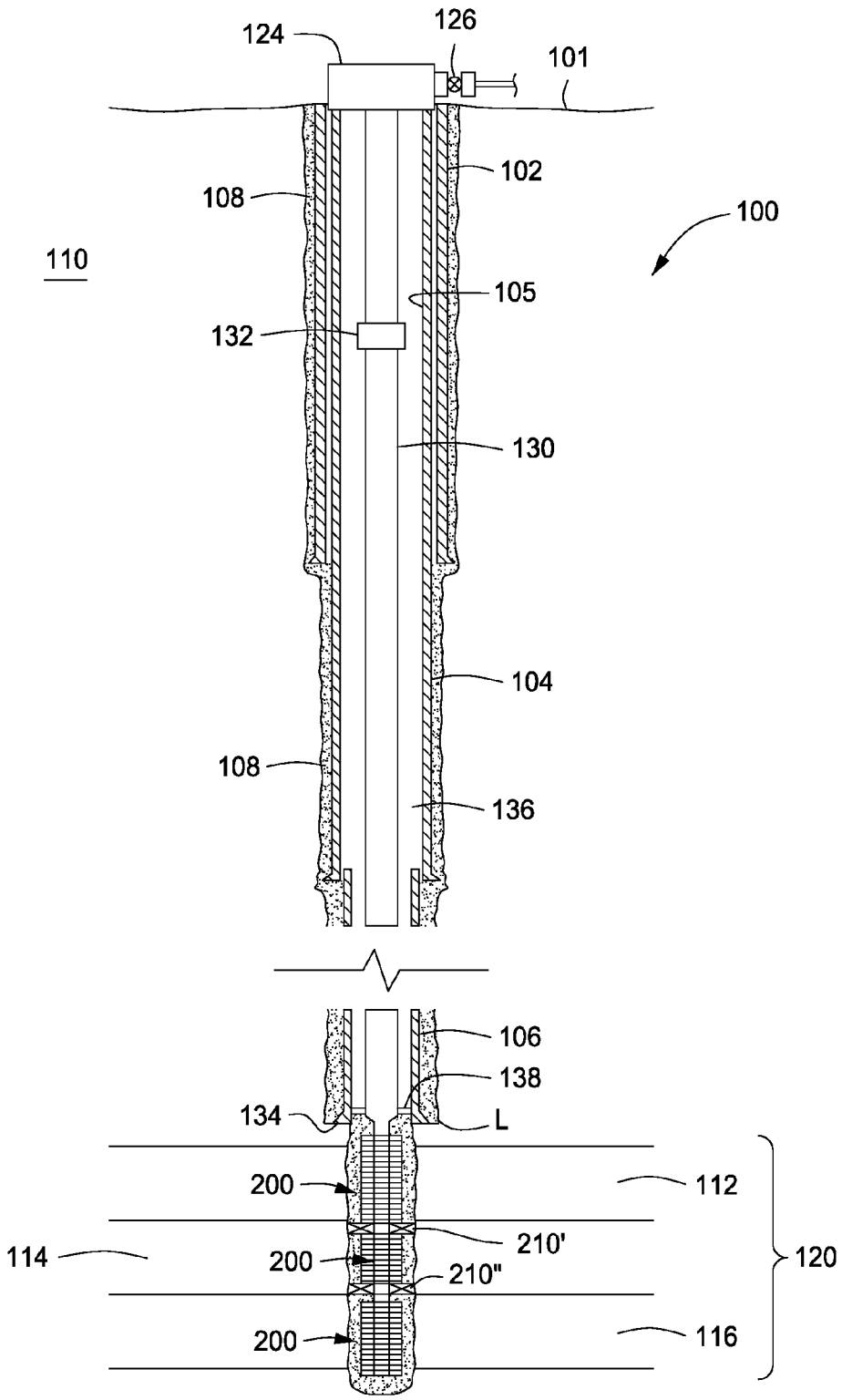
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member" or "tubular body" refer to any pipe or tubular device, such as a joint of casing or base pipe, a portion of a liner, or a pup joint.

The term "sand control device" means any elongated tubular body that permits an inflow of fluid into an inner bore or a base pipe while filtering out predetermined sizes of sand, fines and granular debris from a surrounding formation. A wire wrap screen is an example of a sand control device.

The term "alternate flow channels" means any collection of manifolds and/or shunt tubes that provide fluid communication through or around a tubular wellbore tool to allow a gravel slurry to by-pass the wellbore tool or any premature sand bridge in the annular region and continue gravel packing further downstream. Examples of such wellbore tools include (i) a packer having a sealing element, (ii) a sand screen or slotted pipe, and (iii) a blank pipe, with or without an outer protective shroud.

Description of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for processing or commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through a cement column 108. The cement column 108 isolates the various formations of the subsurface 110 from the wellbore 100 and each other. The column of cement 108 extends from the surface 101 to a depth "L" at a lower end of the casing string 106. It is understood that some intermediate casing strings may not be fully cemented.

An annular region 136 is formed between the production tubing 130 and the casing string 106. A production packer 138 seals the annular region 136 near the lower end "L" of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114. Solutions to these needs in the context of an open-hole completion are provided herein, and are demonstrated more fully in connection with the proceeding drawings.

In connection with the production of hydrocarbon fluids from a wellbore having an open-hole completion, it is not only desirable to isolate selected intervals, but also to limit the influx of sand particles and other fines. In order to prevent the migration of formation particles into the production string 130 during operation, sand control devices 200 have been run into the wellbore 100. These are described more fully below in connection with FIG. 2 and with FIGS. 6A through 6N.

Figure 2:
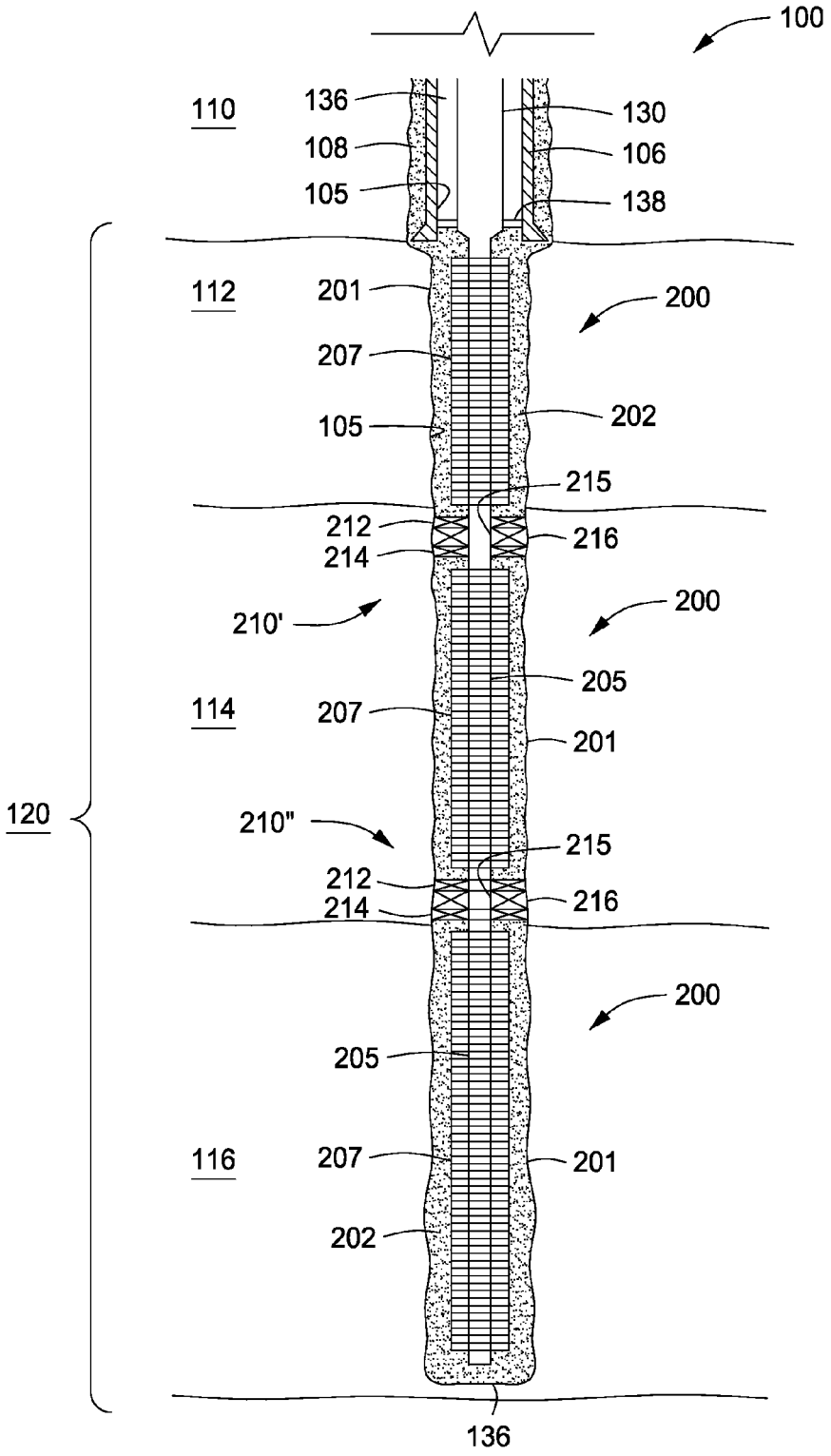
FIG. 2 is an enlarged cross-sectional view of an open-hole completion of the wellbore of FIG. 1. The open-hole completion at the depth of the three illustrative intervals is more clearly seen.

Referring now to FIG. 2, the sand control devices 200 contain an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207 wound or otherwise placed radially around the base pipes 205. The filter medium 207 may be a wire mesh screen or wire wrap fitted around the base pipe 205. Alternatively, the filtering medium of the sand screen may comprise a membrane screen, an expandable screen, a sintered metal screen, a porous media made of shape-memory polymer (such as that described in U.S. Pat. No. 7,926,565), a porous media packed with fibrous material, or a pre-packed solid particle bed. The filter medium 207 prevents the inflow of sand or other particles above a pre-determined size into the base pipe 205 and the production tubing 130.

In addition to the sand control devices 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

FIG. 2 provides an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively. Gravel has been placed within the annular region 202. Finally, the sand control devices 200 along each of the intervals 112, 114, 116 are shown.

Concerning the packer assemblies themselves, each packer assembly 210', 210" may have two separate packers. The packers are preferably set through a combination of mechanical manipulation and hydraulic forces. For purposes of this disclosure, the packers are referred to as being mechanically-set packers. The illustrative packer assemblies 210 represent an upper packer 212 and a lower packer 214. Each packer 212, 214 has an expandable portion or element fabricated from an elastomeric or a thermoplastic material capable of providing at least a temporary fluid seal against a surrounding wellbore wall 201.

The elements for the upper 212 and lower 214 packers should be able to withstand the pressures and loads associated with a gravel packing process. Typically, such pressures are from about 2,000 psi to 5,000 psi. The elements for the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The sealing surface or elements for the mechanically-set packers 212, 214 need only be on the order of inches in order to affect a suitable hydraulic seal. In one aspect, the elements are each about 6 inches (15.2 cm) to about 24 inches (61.0 cm) in length.

It is preferred for the elements of the packers 212, 214 to be able to expand to at least an 11-inch (about 28 cm) outer diameter surface, with no more than a 1.1 ovality ratio. The elements of the packers 212, 214 should preferably be able to handle washouts in an 8½ inch (about 21.6 cm) or 9⅞ inch (about 25.1 cm) open-hole section 120. The expandable portions of the packers 212, 214 will assist in maintaining at least a temporary seal against the wall 201 of the intermediate interval 114 (or other interval) as pressure increases during the gravel packing operation.

The upper 212 and lower 214 packers are set prior to a gravel pack installation process. The elements of the upper 212 and lower 214 packers are expanded into contact with the surrounding wall 201 so as to straddle the annular region 202 at a selected depth along the open-hole completion 120.

FIG. 2 shows a mandrel at 215 in the packers 212, 214. The mandrel serves as a base pipe for supporting the expandable, elastomeric elements.

As a "back-up" to the expandable packer elements within the upper 212 and lower 214 packers, the packer assemblies 210', 210" also each include an intermediate packer element 216. The intermediate packer element 216 defines a swelling elastomeric material fabricated from synthetic rubber compounds. Suitable examples of swellable materials may be found in Easy Well Solutions' Constrictor™ or Swell-Packer™, and SwellFix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

The swellable packer element 216 is preferably bonded to the outer surface of the mandrel 215. The swellable packer element 216 is allowed to expand over time when contacted by hydrocarbon fluids, formation water, or any chemical described above which may be used as an actuating fluid. As the packer element 216 expands, it forms a fluid seal with the surrounding zone, e.g., interval 114. In one aspect, a sealing surface of the swellable packet element 216 is from about 5 feet (1.5 meters) to 50 feet (15.2 meters) in length; and more preferably, about 3 feet (0.9 meters) to 40 feet (12.2 meters) in length.

The swellable packer element 216 must be able to expand to the wellbore wall 201 and provide the required pressure integrity at that expansion ratio. Since swellable packers are typically set in a shale section that may not produce hydrocarbon fluids, it is preferable to have a swelling elastomer or other material that can swell in the presence of formation water or an aqueous-based fluid. Examples of materials that will swell in the presence of an aqueous-based fluid are bentonite clay and a nitrile-based polymer with incorporated water absorbing particles.

Alternatively, the swellable packer element 216 may be fabricated from a combination of materials that swell in the presence of water and oil, respectively. Stated another way, the swellable packer element 216 may include two types of swelling elastomers—one for water and one for oil. In this situation, the water-swellable element will swell when exposed to the water-based gravel pack fluid or in contact with formation water, and the oil-based element will expand when exposed to hydrocarbon production. An example of an elastomeric material that will swell in the presence of a hydrocarbon liquid is oleophilic polymer that absorbs hydrocarbons into its matrix. The swelling occurs from the absorption of the hydrocarbons which also lubricates and decreases the mechanical strength of the polymer chain as it expands. Ethylene propylene diene monomer (M-class) rubber, or EPDM, is one example of such a material.

The swellable packer 216 may be fabricated from other expandable material. An example is a shape-memory polymer. U.S. Pat. Nos. 7,243,732 and 7,392,852 disclose the use of such a material for zonal isolation.

The mechanically-set packer elements 212, 214 are preferably set in a water-based gravel pack fluid that would be diverted around the swellable packer element 216, such as through shunt tubes (not shown in FIG. 2). If only a hydrocarbon swelling elastomer is used, expansion of the element may not occur until after the failure of either of the mechanically-set packer elements 212, 214.

The upper 212 and lower 214 packers may generally be mirror images of each other, except for the release sleeves that shear the respective shear pins or other engagement mechanisms. Unilateral movement of a shifting tool (shown in and discussed in connection with FIGS. 7A and 7B) will allow the packers 212, 214 to be activated in sequence or simultaneously. The lower packer 214 is activated first, followed by the upper packer 212 as the shifting tool is pulled upward through an inner mandrel (shown in and discussed in connection with FIGS. 6A and 6B). A short spacing is preferably provided between the upper 212 and lower 214 packers.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide. The packer assemblies 210', 210" work in novel conjunction with a straddle packer, a plug, or, as described below, an isolation string to control flow from subsurface intervals.

Packers historically have not been installed when an open-hole gravel pack is utilized because of the difficulty in forming a complete gravel pack above and below the packer. Related patent applications, U.S. Publication Nos. 2009/0294128 and 2010/0032158 disclose apparatus' and methods for gravel-packing an open-hole wellbore after a packer has been set at a completion interval.

Certain technical challenges have remained with respect to the methods disclosed in U.S. Pub Nos. 2009/0294128 and 2010/0032158, particularly in connection with the packer. The applications state that the packer may be a hydraulically actuated inflatable element. Such an inflatable element may be fabricated from an elastomeric material or a thermoplastic material. However, designing a packer element from such materials requires the packer element to meet a particularly high performance level. In this respect, the packer element needs to be able to maintain zonal isolation for a period of years in the presence of high pressures and/or high temperatures and/or acidic fluids. As an alternative, the applications state that the packer may be a swelling rubber element that expands in the presence of hydrocarbons, water, or other stimulus. However, known swelling elastomers typically require about 30 days or longer to fully expand into sealed fluid engagement with the surrounding rock formation. Therefore, improved packers and zonal isolation apparatus' are offered herein.

Figure 3A:
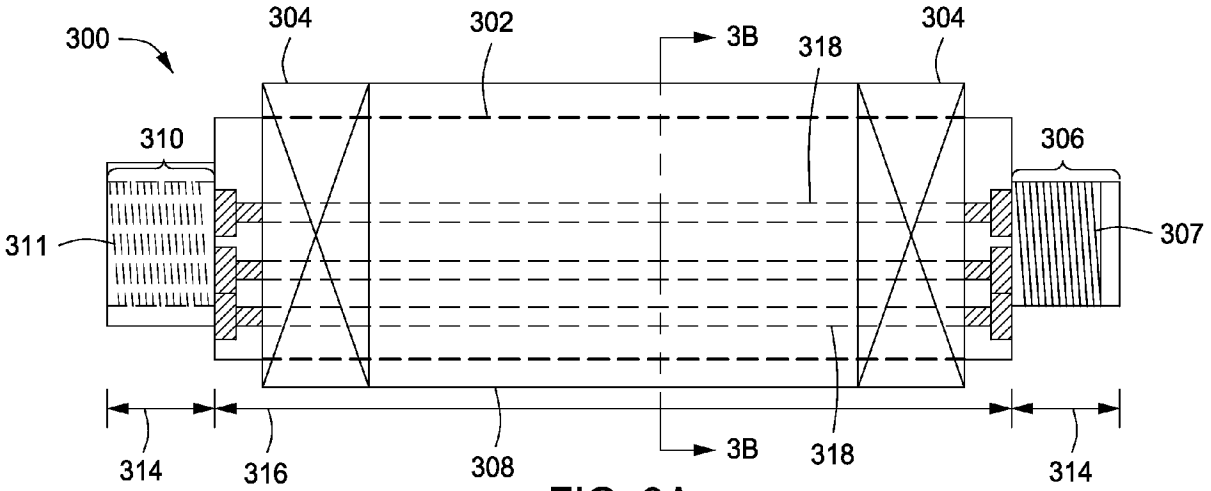
FIG. 3A is a cross-sectional side view of a packer assembly, in one embodiment. Here, a base pipe is shown, with surrounding packer elements. Two mechanically-set packers are shown, along with an intermediate swellable packer element.

FIG. 3A presents an illustrative packer assembly 300 providing an alternate flowpath for a gravel slurry. The packer assembly 300 is generally seen in cross-sectional side view. The packer assembly 300 includes various components that may be utilized to seal an annulus along the open-hole portion 120.

The packer assembly 300 first includes a main body section 302. The main body section 302 is preferably fabricated from steel or from steel alloys. The main body section 302 is configured to be a specific length 316, such as about 40 feet (12.2 meters). The main body section 302 comprises individual pipe joints that will have a length that is between about 10 feet (3.0 meters) and 50 feet (15.2 meters). The pipe joints are typically threadedly connected end-to-end to form the main body section 302 according to length 316.

The packer assembly 300 also includes opposing mechanically-set packers 304. The mechanically-set packers 304 are shown schematically, and are generally in accordance with mechanically-set packer elements 212 and 214 of FIG. 2. The packers 304 preferably include cup-type elastomeric elements that are less than 1 foot (0.3 meters) in length. As described further below, the packers 304 have alternate flow channels that uniquely allow the packers 304 to be set before a gravel slurry is circulated into the wellbore.

The packer assembly 300 also optionally includes a swellable packer 308. The swellable packer 308 is in accordance with swellable packer element 216 of FIG. 2. The swellable packer 308 is preferably about 3 feet (0.9 meters) to 40 feet (12.2 meters) in length. Together, the mechanically-set packers 304 and the intermediate swellable packer 308 surround the main body section 302. Alternatively, a short spacing may be provided between the mechanically-set packers 304 in lieu of the swellable packer 308.

The packer assembly 300 also includes a plurality of shunt tubes. The shunt tubes are seen in phantom at 318. The shunt tubes 318 may also be referred to as transport tubes or alternate flow channels. The shunt tubes 318 are blank sections of pipe having a length that extends along the length 316 of the mechanically-set packers 304 and the swellable packer 308. The shunt tubes 318 on the packer assembly 300 are configured to couple to and form a seal with shunt tubes on connected sand screens, as discussed further below.

The shunt tubes 318 provide an alternate flowpath through the mechanically-set packers 304 and the intermediate swellable packer 308 (or spacing). This enables the shunt tubes 318 to transport a carrier fluid along with gravel to different intervals 112, 114 and 116 of the open-hole portion 120 of the wellbore 100.

The packer assembly 300 also includes connection members. These may represent traditional threaded couplings. First, a neck section 306 is provided at a first end of the packer assembly 300. The neck section 306 has external threads for connecting with a threaded coupling box of a sand screen or other pipe. Then, a notched or externally threaded section 310 is provided at an opposing second end. The threaded section 310 serves as a coupling box for receiving an external threaded end of a sand screen or other tubular member.

The neck section 306 and the threaded section 310 may be made of steel or steel alloys. The neck section 306 and the threaded section 310 are each configured to be a specific length 314, such as 4 inches (10.2 cm) to 4 feet (1.2 meters) (or other suitable distance). The neck section 306 and the threaded section 310 also have specific inner and outer diameters. The neck section 306 has external threads 307, while the threaded section 310 has internal threads 311. These threads 307 and 311 may be utilized to form a seal between the packer assembly 300 and sand control devices or other pipe segments.

Figure 3B:
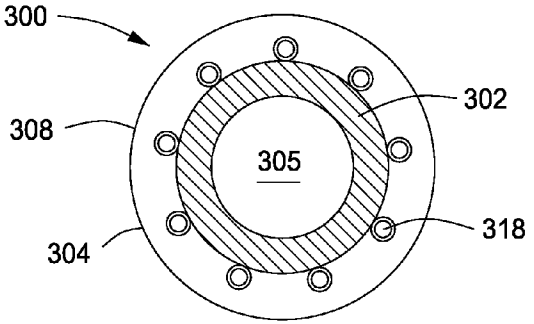
FIG. 3B is a cross-sectional view of the packer assembly of FIG. 3A, taken across lines 3B-3B of FIG. 3A. Shunt tubes are seen within the swellable packer element.

A cross-sectional view of the packer assembly 300 is shown in FIG. 3B. FIG. 3B is taken along the line 3B-3B of FIG. 3A. In FIG. 3B, the swellable packer 308 is seen circumferentially disposed around the base pipe 302. Various shunt tubes 318 are placed radially and equidistantly around the base pipe 302. A central bore 305 is shown within the base pipe 302. The central bore 305 receives production fluids during production operations and conveys them to the production tubing 130.

Figure 4A:
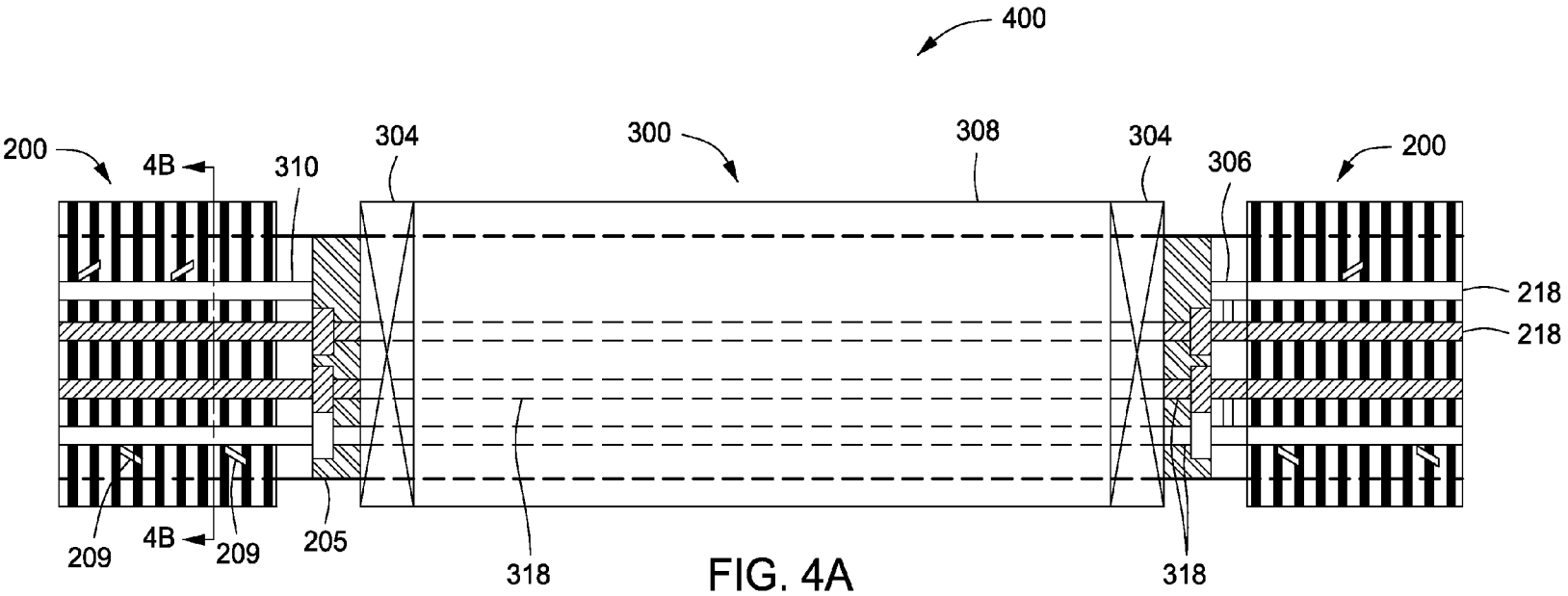
FIG. 4A is a cross-sectional side view of the packer assembly of FIG. 3A. Here, sand control devices, or sand screens, have been placed at opposing ends of the packer assembly. The sand control devices utilize external shunt tubes.

FIG. 4A presents a cross-sectional side view of a zonal isolation apparatus 400, in one embodiment. The zonal isolation apparatus 400 includes the packer assembly 300 from FIG. 3A. In addition, sand control devices 200 have been connected at opposing ends to the neck section 306 and the notched section 310, respectively. Shunt tubes 318 from the packer assembly 300 are seen connected to shunt tubes 218 on the sand control devices 200. The shunt tubes 218 represent packing tubes that allow the flow of gravel slurry between a wellbore annulus and the tubes 218. The shunt tubes 218 on the sand control devices 200 optionally include valves 209 to control the flow of gravel slurry such as to packing tubes (not shown).

Figure 4B:
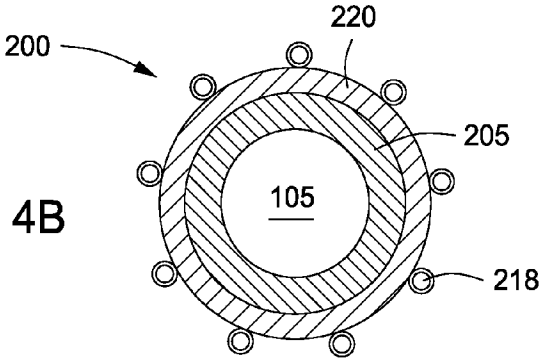
FIG. 4B provides a cross-sectional view of the packer assembly of FIG. 4A, taken across lines 4B-4B of FIG. 4A. Shunt tubes are seen outside of the sand screen to provide an alternative flowpath for a particulate slurry.

FIG. 4B provides a cross-sectional side view of the zonal isolation apparatus 400. FIG. 4B is taken along the line 4B-4B of FIG. 4A. This is cut through one of the sand screens 200. In FIG. 4B, the slotted or perforated base pipe 205 is seen. This is in accordance with base pipe 205 of FIGS. 1 and 2. A central bore 105 is shown within the base pipe 205 for receiving production fluids during production operations.

An outer mesh 220 is disposed immediately around the base pipe 205. The outer mesh 220 preferably comprises a wire mesh or wires helically wrapped around the base pipe 205, and serves as a screen. In addition, shunt tubes 218 are placed radially and equidistantly around the outer mesh 205. This means that the sand control devices 200 provide an external embodiment for the shunt tubes 218 (or alternate flow channels).

The configuration of the shunt tubes 218 is preferably concentric. This is seen in the cross-sectional views of FIGS. 3B and 4B. However, the shunt tubes 218 may be eccentrically designed. For example, FIG. 2B in U.S. Pat. No. 7,661,476 presents a "Prior Art" arrangement for a sand control device wherein packing tubes 208*a* and transport tubes 208*b* are placed external to the base pipe 202 and surrounding filter medium 204, forming an eccentric arrangement.

In the arrangement of FIGS. 4A and 4B, the shunt tubes 218 are external to the filter medium, or outer mesh 220. However, the configuration of the sand control device 200 may be modified. In this respect, the shunt tubes 218 may be moved internal to the filter medium 220.

Figure 5A:
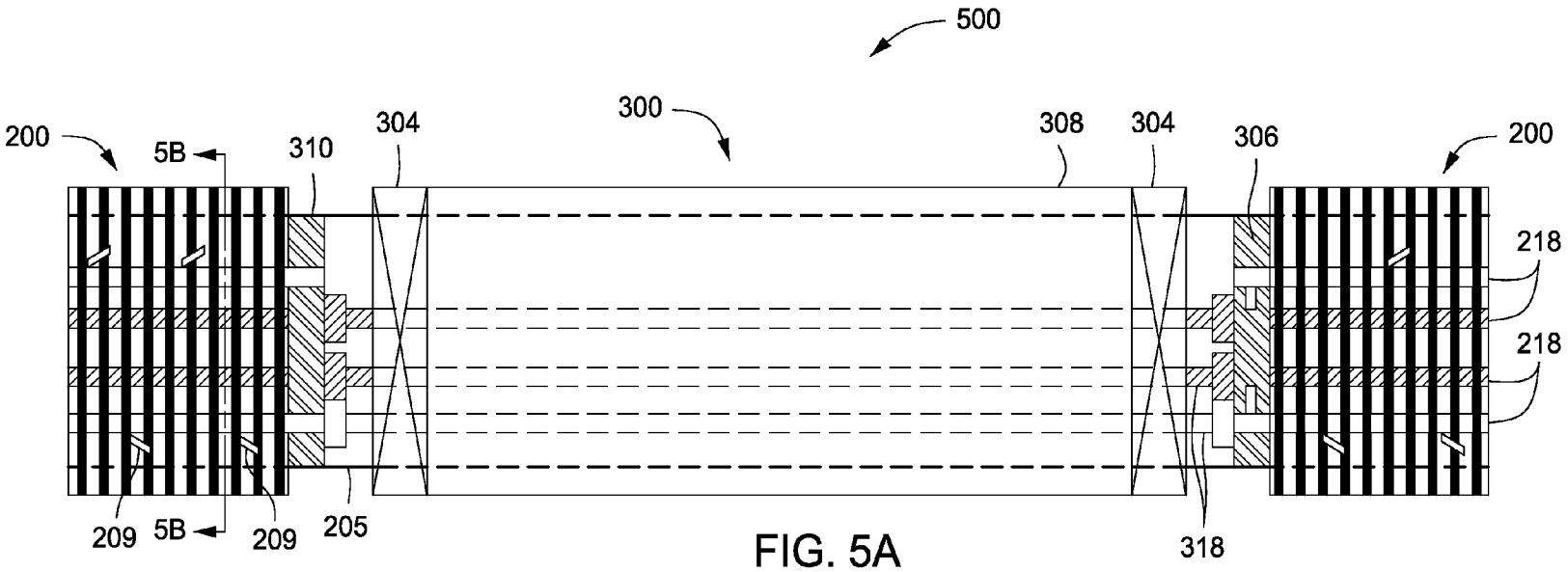
FIG. 5A is another cross-sectional side view of the packer assembly of FIG. 3A. Here, sand control devices, or sand screens, have again been placed at opposing ends of the packer assembly. However, the sand control devices utilize internal shunt tubes.

FIG. 5A presents a cross-sectional side view of a zonal isolation apparatus 500, in an alternate embodiment. In this embodiment, sand control devices 200 are again connected at opposing ends to the neck section 306 and the notched section 310, respectively, of the packer assembly 300. In addition, shunt tubes 318 on the packer assembly 300 are seen connected to shunt tubes 218 on the sand control assembly 200. However, in FIG. 5A, the sand control assembly 200 utilizes internal shunt tubes 218, meaning that the shunt tubes 218 are disposed between the base pipe 205 and the surrounding filter medium 220.

Figure 5B:
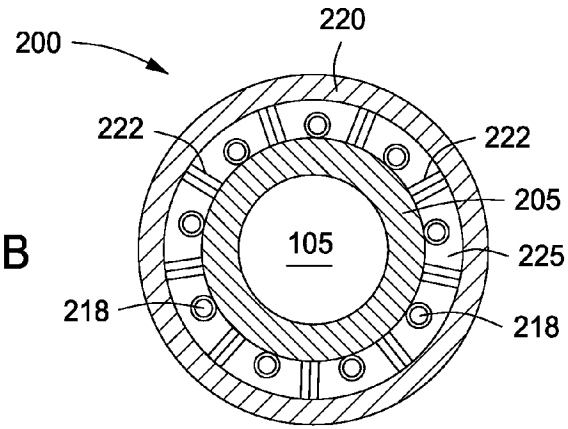
FIG. 5B provides a cross-sectional view of the packer assembly of FIG. 5A, taken across lines 5B-5B of FIG. 5A. Shunt tubes are seen within the sand screen to provide an alternative flowpath for a particulate slurry.

FIG. 5B provides a cross-sectional side view of the zonal isolation apparatus 500. FIG. 5B is taken along the line B-B of FIG. 5A. This is cut through one of the sand screens 200. In FIG. 5B, the slotted or perforated base pipe 205 is again seen. This is in accordance with base pipe 205 of FIGS. 1 and 2. The central bore 105 is shown within the base pipe 205 for receiving production fluids during production operations.

Shunt tubes 218 are placed radially and equidistantly around the base pipe 205. The shunt tubes 218 reside immediately around the base pipe 205, and within a surrounding filter medium 220. This means that the sand control devices 200 of FIGS. 5A and 5B provide an internal embodiment for the shunt tubes 218.

An annular region 225 is created between the base pipe 205 and the surrounding outer mesh or filter medium 220. The annular region 225 accommodates the inflow of production fluids in a wellbore. The outer wire wrap 220 is supported by a plurality of radially extending support ribs 222. The ribs 222 extend through the annular region 225.

FIGS. 4A and 5A present arrangements for connecting sand screens 200 to a packer assembly. Shunt tubes 318 (or alternate flow channels) within the packer assembly 300 fluidly connect to shunt tubes 218 along the sand screens 200. However, the zonal isolation apparatus arrangements 400, 500 of FIGS. 4A-4B and 5A-5B are merely illustrative. In an alternative arrangement, a manifolding system may be used for providing fluid communication between the shunt tubes 218 and the shunt tubes 318.

Figure 3C:
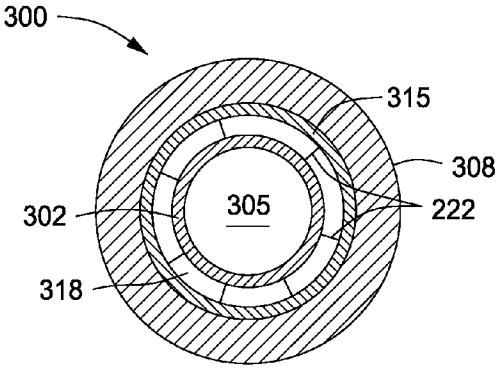
FIG. 3C is a cross-sectional view of the packer assembly of FIG. 3A, in an alternate embodiment. In lieu of shunt tubes, transport tubes are seen manifolded around the base pipe.

FIG. 3C is a cross-sectional view of the packer assembly 300 of FIG. 3A, in an alternate embodiment. In this arrangement, shunt tubes 318 are manifolded around the base pipe 302. A support ring 315 is provided around the shunt tubes 318. It is again understood that the present apparatus and methods are not confined by the particular design and arrangement of shunt tubes 318 so long as slurry bypass is provided for the packer assembly 210. However, it is preferred that a concentric arrangement be employed.

It should also be noted that the coupling mechanism for the sand control devices 200 with the packer assembly 300 may include a sealing mechanism (not shown). The sealing mechanism prevents leaking of the slurry that is in the alternate flowpath formed by the shunt tubes. Examples of such sealing mechanisms are described in U.S. Pat. No. 6,464,261; Intl. Pat. Application No. WO 2004/094769; Intl. Pat. Application No. WO 2005/031105; U.S. Pat. Publ. No. 2004/0140089; U.S. Pat. Publ. No. 2005/0028977; U.S. Pat. Publ. No. 2005/0061501; and U.S. Pat. Publ. No. 2005/0082060.

Coupling sand control devices 200 with a packer assembly 300 requires alignment of the shunt tubes 318 in the packer assembly 300 with the shunt tubes 218 along the sand control devices 200. In this respect, the flow path of the shunt tubes 218 in the sand control devices should be un-interrupted when engaging a packer. FIG. 4A (described above) shows sand control devices 200 connected to an intermediate packer assembly 300, with the shunt tubes 218, 318 in alignment. However, making this connection typically requires a special sub or jumper with a union-type connection, a timed connection to align the multiple tubes, or a cylindrical cover plate over the connecting tubes. These connections are expensive, time-consuming, and/or difficult to handle on the rig floor.

U.S. Pat. No. 7,661,476, entitled "Gravel Packing Methods," discloses a production string (referred to as a joint assembly) that employs one or more sand screen joints. The sand screen joints are placed between a "load sleeve assembly" and a "torque sleeve assembly." The load sleeve assembly defines an elongated body comprising an outer wall (serving as an outer diameter) and an inner wall (providing an inner diameter). The inner wall forms a bore through the load sleeve assembly. Similarly, the torque sleeve assembly defines an elongated body comprising an outer wall (serving as an outer diameter) and an inner wall (providing an inner diameter). The inner wall also forms a bore through the torque sleeve assembly.

The load sleeve assembly includes at least one transport conduit and at least one packing conduit. The at least one transport conduit and the at least one packing conduit are disposed exterior to the inner diameter and interior to the outer diameter. Similarly, the torque sleeve assembly includes at least one conduit. The at least one conduit is also disposed exterior to the inner diameter and interior to the outer diameter.

The production string includes a "main body portion." This is essentially a base pipe that runs through the sand screen. A coupling assembly having a manifold region may also be provided. The manifold region is configured to be in fluid flow communication with the at least one transport conduit and the at least one packing conduit of the load sleeve assembly during at least a portion of gravel packing operations. The coupling assembly is operably attached to at least a portion of the at least one joint assembly at or near the load sleeve assembly. The load sleeve assembly and the torque sleeve assembly are made up or coupled with the base pipe in such a manner that the transport and packing conduits are in fluid communication, thereby providing alternate flow channels for gravel slurry. The benefit of the load sleeve assembly, the torque sleeve assembly, and coupling assembly is that they enable a series of sand screen joints to be connected and run into the wellbore in a faster and less expensive manner.

As noted, the packer assembly 300 includes a pair of mechanically-set packers 304. When using the packer assembly 300, the packers 304 are beneficially set before the slurry is injected and the gravel pack is formed. This requires a unique packer arrangement wherein shunt tubes are provided for an alternate flow channel.

The packers 304 of FIG. 3A are shown schematically. However, details concerning suitable packers for a gravel pack zonal isolation apparatus are described in prior patent documents. For example, U.S. Pat. No. 5,588,487 entitled "Tool for Blocking Axial Flow in Gravel-Packed Well Annulus," describes a well screen having pairs of packer elements.

The well screen includes shunt tubes which allow a gravel slurry to by-pass the pairs of packer elements during a gravel-packing procedure. Also, U.S. Prov. Pat. Appl. No. 61/424,427, entitled "Packer for Alternate Path Gravel Packing, and Method for Completing a Wellbore," describes a mechanically-set packer that may be run into a wellbore with a sand screen. The packer includes alternate flow channels that allow a gravel slurry to by-pass associated packer elements. The packer is preferably set before a gravel-packing procedure is carried out. The packers may additionally include a swellable packer element as described above, so long as it incorporates a shunt tube for carrying gravel slurry past the swellable packer during gravel packing.

It is preferred that the packer is a packer assembly comprising at least one mechanically-set packer. Each mechanically-set packer includes a sealing element, an inner mandrel, and at least one alternate flow channel. The alternate flow channel is in fluid communication with alternate flow channels in a sand screen. The packer assembly is connected to the sand screen before or at time of run-in.

In the preferred arrangement of U.S. Prov. Pat. Appl. No. 61/424,427, the packers each have a piston housing. The piston housing is held in place along a piston mandrel during run-in. The piston housing is secured using a release sleeve and a release key. The release sleeve and release key prevent relative translational movement between the piston housing and the piston mandrel.

After run-in, the packers are set by mechanically shearing the shear pin and sliding the release sleeve. This, in turn, releases the release key, which then allows hydrostatic pressure to act downwardly against the piston housing. The piston housing travels relative to the piston mandrel. In one aspect, after the shear pins have been sheared, the piston housing slides along an outer surface of the piston mandrel. The piston housing then acts upon a centralizer. The centralizer may be, for example, as described in WO 2009/071874, entitled "Improved Centraliser."

As the piston housing travels along the inner mandrel, it also applies a force against the packing element. The centralizer and the expandable packing elements of the packers expand against the wellbore wall.

The packers may be set using a setting tool that is run into the wellbore with a washpipe. The setting tool may simply be a profiled portion of the washpipe body for the gravel-packing operation. Preferably, however, the setting tool is a separate tubular body that is threadedly connected to the washpipe. Such a setting tool is shown in and described in connection with FIG. 7C of U.S. Prov. Pat. Appl. No. 61/424,427.

Concerning the sand control devices 200, various embodiments of sand control devices 200 may be used with the apparatuses and methods herein. For example, the sand control devices may include stand-alone screens (SAS), prepacked screens, or membrane screens. The joints may be any combination of screen, blank pipe, or zonal isolation apparatus'.

Figure 6A:
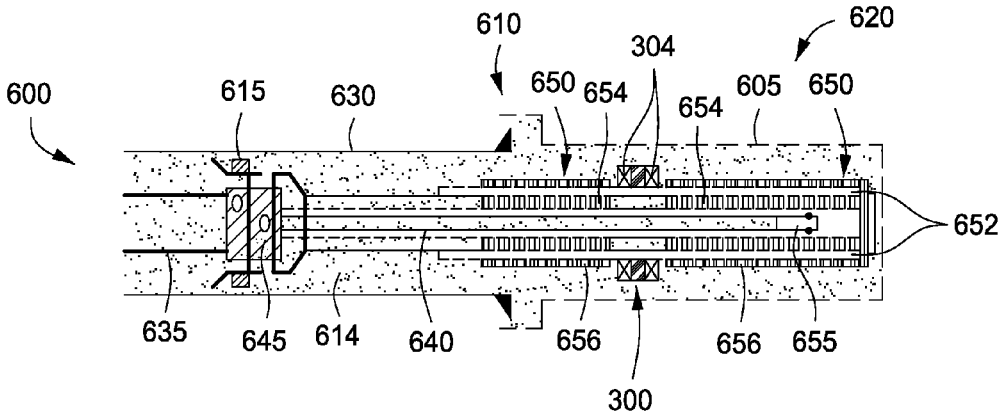
FIGS. 6A through 6N present stages of a gravel packing procedure using one of the packer assemblies of the present invention, in one embodiment. Alternate flowpath channels are provided through the packer elements of the packer assembly and through sand control devices.

Once the packer 304 is set, gravel packing operations may commence. FIGS. 6A through 6N present stages of a gravel packing procedure, in one embodiment. The gravel packing procedure uses a packer assembly having alternate flow channels. The packer assembly may be in accordance with packer assembly 300 of FIG. 3A. The packer assembly 300 will have mechanically-set packers 304. These mechanically-set packers may again be in accordance with the packer described in U.S. Prov. Pat. Appl. No. 61/424,427 filed 17 Dec. 2010, for example.

In FIGS. 6A through 6N, sand control devices are utilized in an illustrative gravel packing procedure in a conditioned drilling mud. The conditioned drilling mud may be a non-aqueous fluid (NAF) such as a solids-laden oil-based fluid. Optionally, a solids-laden water-based fluid is also used. This process, which is a two-fluid process, may include techniques similar to the process discussed in International Pat. Appl. No. WO/2004/079145 and related U.S. Pat. No. 7,373,978, each of which is hereby incorporated by reference. However, it should be noted that this example is simply for illustrative purposes, as other suitable processes and fluids may be utilized.

In FIG. 6A, a wellbore 600 is shown. The illustrative wellbore 600 is a horizontal, open-hole wellbore. The wellbore 600 includes a wall 605. Two different production intervals are indicated along the horizontal wellbore 600. These are shown at 610 and 620. Two sand control devices 650 have been run into the wellbore 600. Separate sand control devices 650 are provided in each production interval 610, 620.

Each of the sand control devices 650 is comprised of a base pipe 654 and a surrounding sand screen 656. The base pipes 654 have slots or perforations to allow fluid to flow into the base pipe 654. The base pipes 654 are provided in a series of separate joints that are preferably about 30 feet (9.14 meters) in length. The sand control devices 650 also each include alternate flow paths. These may be in accordance with shunt tubes 218 from either FIG. 4B or FIG. 5B. Preferably, the shunt tubes are internal shunt tubes disposed between the base pipes 654 and the sand screens 656 along the annular region shown at 652.

The sand control devices 650 are connected via an intermediate packer assembly 300. In the arrangement of FIG. 6A, the packer assembly 300 is installed at the interface between production intervals 610 and 620. More than one packer assembly 300 can be incorporated. The connection between the sand control devices 650 and a packer assembly 300 may be in accordance with U.S. Pat. No. 7,661,476, discussed above.

In addition to the sand control devices 650, a washpipe 640 has been lowered into the wellbore 600. The washpipe 640 is run into the wellbore 600 below a crossover tool or a gravel pack service tool (not shown) which is attached to the end of a drill pipe 635 or other working string. The washpipe 640 is an elongated tubular member that extends into the sand screens 656. The washpipe 640 aids in the circulation of the gravel slurry during a gravel packing operation, and is subsequently removed. Attached to the washpipe 640 is a shifting tool 655. The shifting tool 655 is positioned below the packer assembly 300. The shifting tool is used to activate the packers 304.

In FIG. 6A, a crossover tool 645 is placed at the end of the drill pipe 635. The crossover tool 645 is used to direct the injection and circulation of the gravel slurry, as discussed in further detail below.

A separate packer 615 is connected to the crossover tool 645. The packer 615 and connected crossover tool 645 are temporarily positioned within a string of production casing 630. Together, the packer 615, the crossover tool 645, the elongated washpipe 640, the shifting tool 655, and the gravel pack screens 656 are run into the lower end of the wellbore 600. The packer 615 is set in the production casing 630. The crossover tool 645 is selectively moved between forward and reverse circulation positions.

Returning to FIG. 6A, a conditioned NAF (or other drilling mud) 614 is placed in the wellbore 600. The term "conditioned" means that the drilling mud has been filtered or otherwise cleaned. The drilling mud 614 may be conditioned over mesh shakers (not shown) before the sand control devices 650 are run into the wellbore 600 to reduce any potential plugging of the sand control devices 650. Preferably, the conditioned drilling mud 614 is deposited into the wellbore 600 and delivered to the open-hole portion before the drill string 635 and attached sand screens 656 and washpipe 640 are run into the wellbore 600.

Figure 6B:
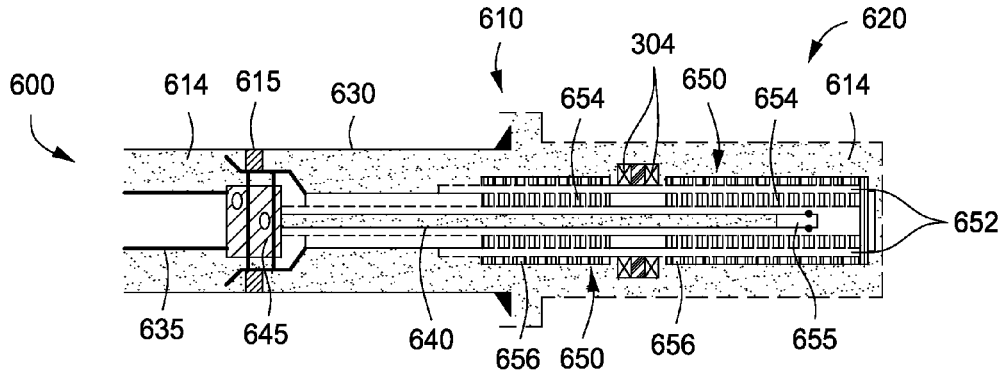
FIG. 6O shows the packer assembly and gravel pack having been set in an open-hole wellbore following completion of the gravel packing procedure from FIGS. 6A through 6N.

In FIG. 6B, the packer 615 is set in the production casing string 630. This means that the packer 615 is actuated to extend slips and an elastomeric sealing element against the surrounding casing string 630. The packer 615 is set above the intervals 610 and 620, which are to be gravel packed. The packer 615 seals the intervals 610 and 620 from the portions of the wellbore 600 above the packer 615.

Figure 6C:
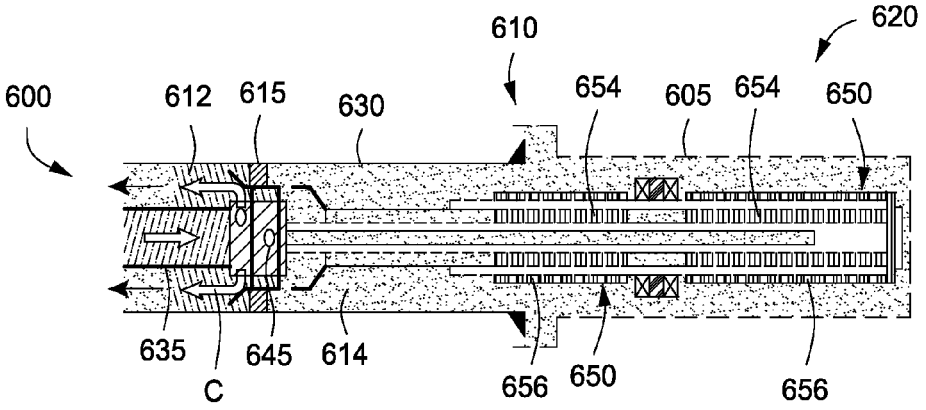

After the packer 615 is set, as shown in FIG. 6C, the crossover tool 645 is shifted up into a reverse position. Circulation pressures can be taken in this position. A carrier fluid 612 is pumped down the drill pipe 635 and placed into an annulus between the drill pipe 635 and the surrounding production casing 630 above the packer 615. The carrier fluid is a gravel carrier fluid, which is the liquid component of the gravel packing slurry. The carrier fluid 612 displaces the conditioned drilling fluid 614 above the packer 615, which again may be an oil-based fluid such as the conditioned NAF. The carrier fluid 612 displaces the drilling fluid 614 in the direction indicated by arrows "C."

Figure 6D:
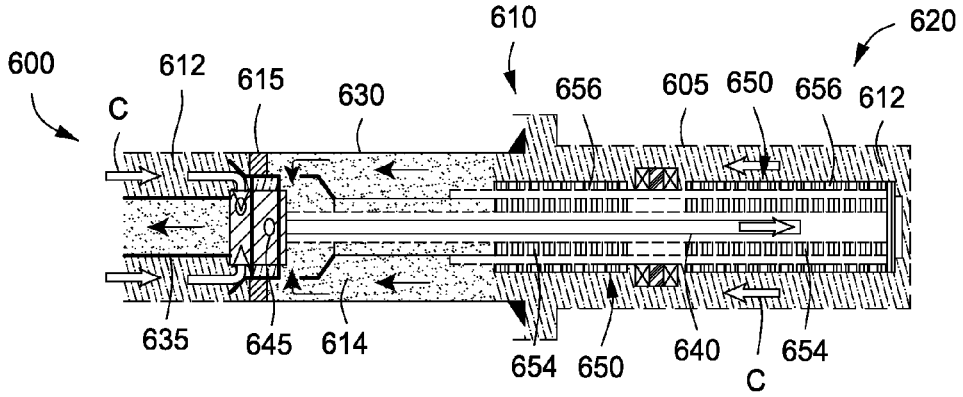

Next, in FIG. 6D, the crossover tool 645 is shifted back into a forward circulating position. This is the position used for circulating gravel pack slurry into the open-hole portion of the wellbore, and is sometimes referred to as the gravel pack position. The earlier-placed carrier fluid 612 is pumped down the annulus between the drill pipe 635 and the production casing 630. The carrier fluid 612 is further pumped down the washpipe 640. This pushes the conditioned drilling mud 614 down the washpipe 640, out the sand screens 656, sweeping the open-hole annulus between the sand screens 656 and the surrounding wall 605 of the open-hole portion of the wellbore 600, through the crossover tool 645, and back up the drill pipe 635. The flow path of the carrier fluid 612 is again indicated by the arrows "C."

Figure 6E:
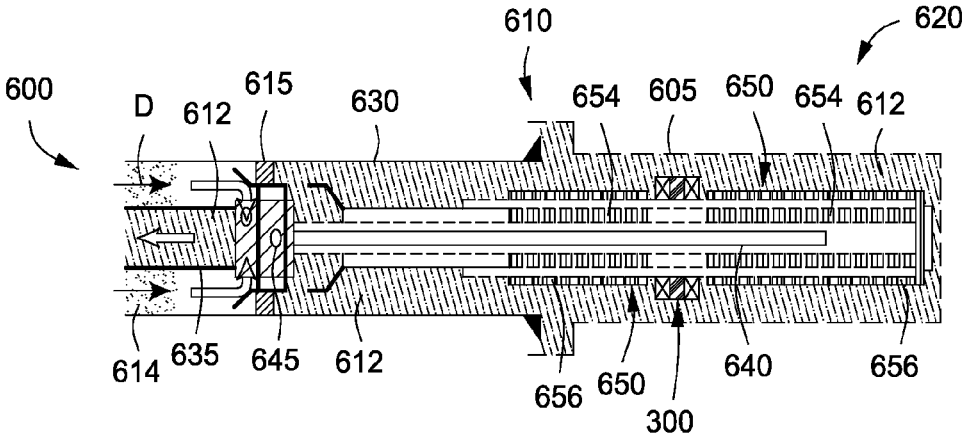
Figure 6F:
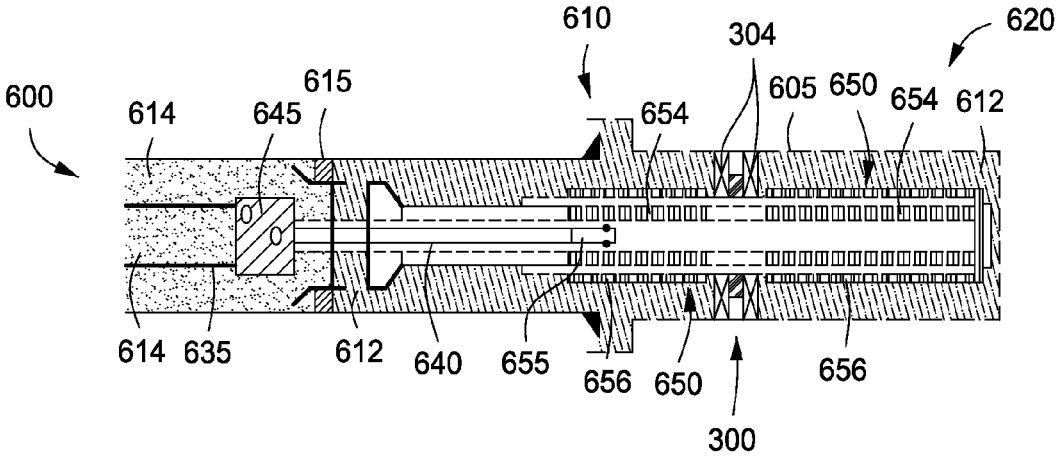
Figure 6G:
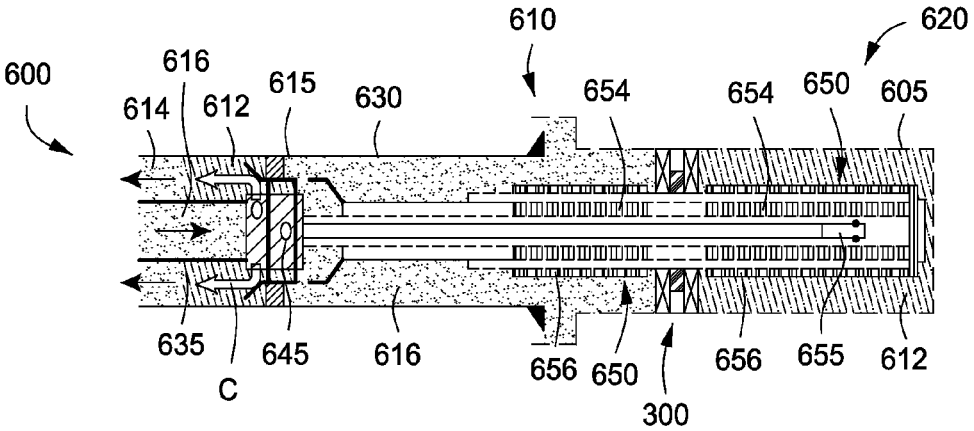

In FIGS. 6E through 6G, the production intervals 610, 620 are prepared for gravel packing.

In FIG. 6E, once the open-hole annulus between the sand screens 656 and the surrounding wall 605 has been swept with carrier fluid 612, the crossover tool 645 is shifted back to the reverse circulating position. Conditioned drilling fluid 614 is pumped down the annulus between the drill pipe 635 and the production casing 630 to force the carrier fluid 612 out of the drill pipe 635, as shown by the arrows "D." These fluids may be removed from the drill pipe 635.

Next, the packers 304 are set, as shown in FIG. 6F. This is done by pulling the shifting tool 655 located below the packer assembly 300 on the washpipe 640 and up past the packer assembly 300. More specifically, the mechanically-set packers 304 of the packer assembly 300 are set. The packers 304 may be, for example, the packer described in U.S. Prov. Pat. Appl. No. 61/424,427. The packers 304 are used to isolate the annulus formed between the sand screens 656 and the surrounding wall 605 of the wellbore 600.

The washpipe 640 is lowered to a reverse position. While in the reverse position, as shown in FIG. 6G, the carrier fluid with gravel 616 may be placed within the drill pipe 635 and utilized to force the carrier fluid 612 up the annulus formed between the drill pipe 635 and production casing 630 above the packer 615. Reverse circulation of the carrier fluid is shown by the arrows "C."

Figure 6H:
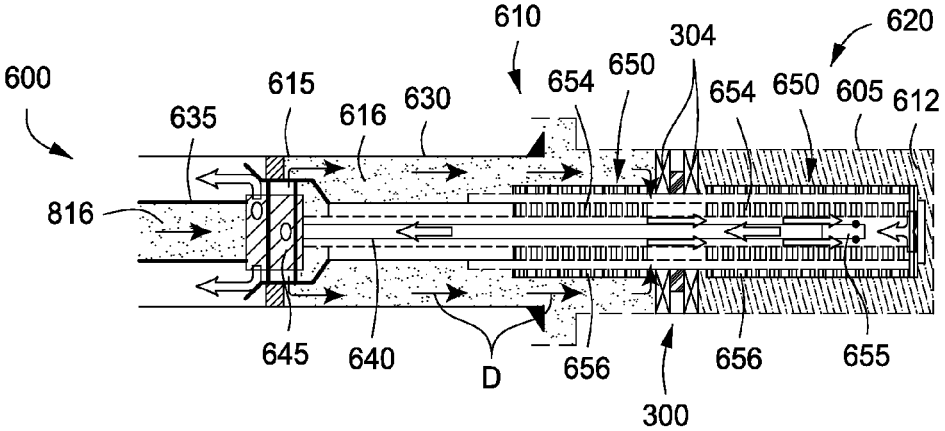
Figure 6I:
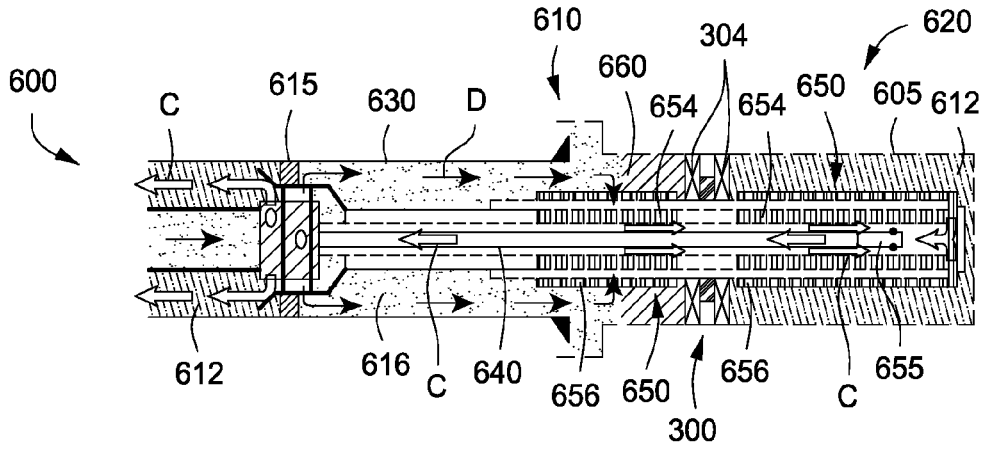
Figure 6J:
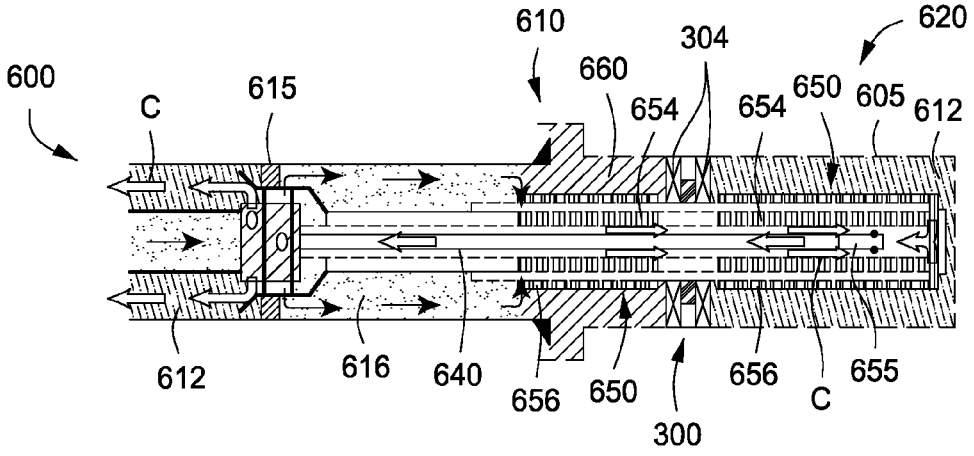

In FIGS. 6H through 6J, the crossover tool 645 may be shifted into the forward circulating position (or gravel packing position) to gravel pack the first subsurface interval 610.

In FIG. 6H, the carrier fluid with gravel 616 begins to create a gravel pack within the production interval 610 above the packer assembly 300 in the annulus between the sand screen 656 and the wall 605 of the open-hole wellbore 600. The fluid flows outside the sand screen 656 and returns through the washpipe 640 as indicated by the arrows "D." The carrier fluid 612 in the wellbore annulus is forced into screen, through the washpipe 640, and up the annulus formed between the drill pipe 635 and production casing 630 above the packer 615.

In FIG. 6I, a first gravel pack 660 begins to form above the packer 300. The gravel pack 660 is forming around the sand screen 656 and towards the packer 615. Carrier fluid 612 is circulated below the packer assembly 300 and to the bottom of the wellbore 600. The carrier fluid 612 without gravel flows up the washpipe 640 as indicated by arrows "C."

In FIG. 6J, the gravel packing process continues to form the gravel pack 660 toward the packer 615. The sand screen 656 is now being fully covered by the gravel pack 660 above the packer assembly 300. Carrier fluid 612 continues to be circulated below the packer assembly 300 and to the bottom of the wellbore 600. The carrier fluid 612 sans gravel flows up the washpipe 640 as again indicated by arrows "C."

Once the gravel pack 660 is formed in the first interval 610 and the sand screens above the packer assembly 300 are covered with gravel, the carrier fluid with gravel 616 is forced through the shunt tubes (such as shunt tubes 318 in FIG. 3B). The carrier fluid with gravel 616 forms the gravel pack 660 in FIGS. 6K through 6N.

Figure 6K:
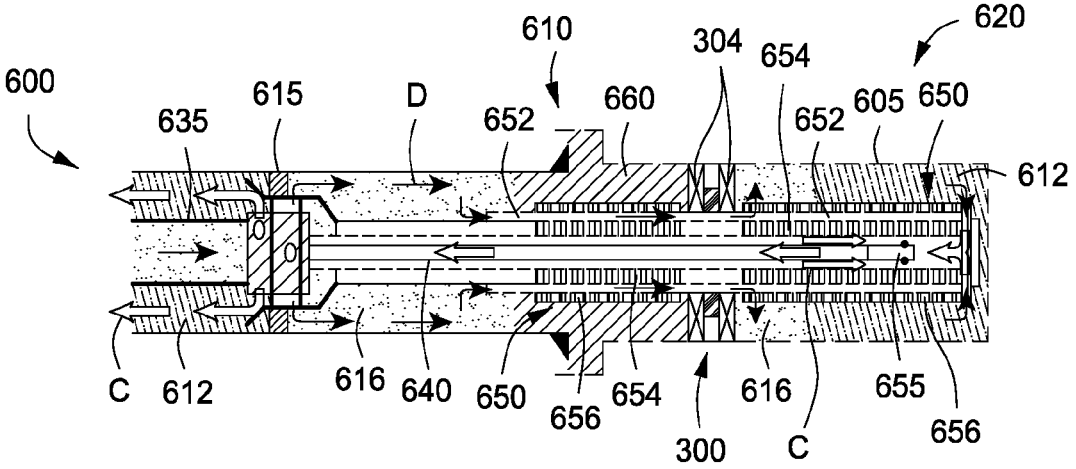

In FIG. 6K, the carrier fluid with gravel 616 now flows within the production interval 620 below the packer assembly 300. The carrier fluid 616 flows through the shunt tubes and packer assembly 300, and then outside the sand screen 656. The carrier fluid 616 then flows in the annulus between the sand screen 656 and the wall 605 of the wellbore 600, and returns through the washpipe 640. The flow of carrier fluid with gravel 616 is indicated by arrows "D," while the flow of carrier fluid in the washpipe 640 without the gravel is indicated at 612, shown by arrows "C."

It is noted here that slurry only flows through the bypass channels along the packer sections. After that, slurry will go into the alternate flow channels in the next, adjacent screen joint. Alternate flow channels have both transport and packing tubes manifolded together at each end of a screen joint. Packing tubes are provided along the sand screen joints. The packing tubes represent side nozzles that allow slurry to fill any voids in the annulus. Transport tubes will take the slurry further downstream.

Figure 6L:
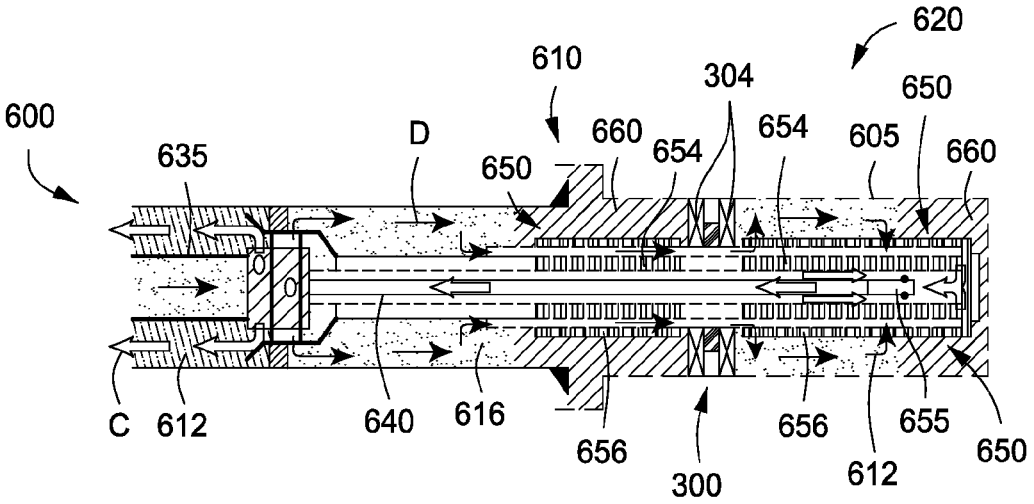
Figure 6M:
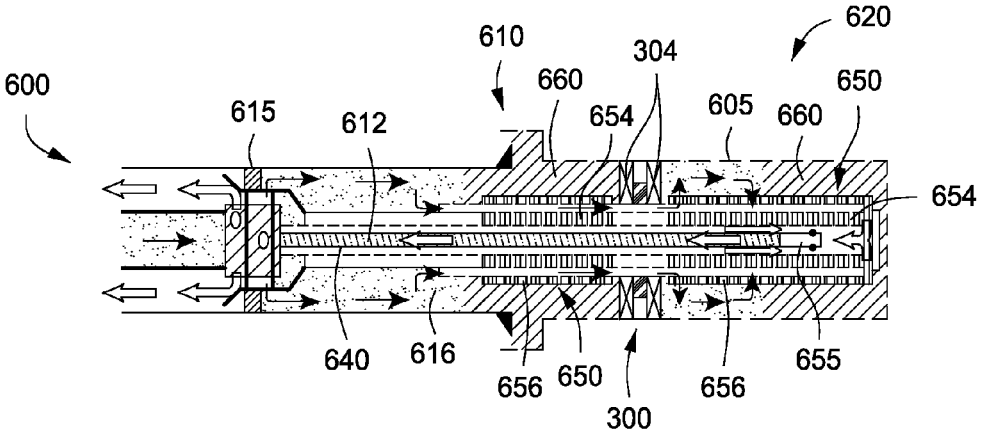
Figure 6N:
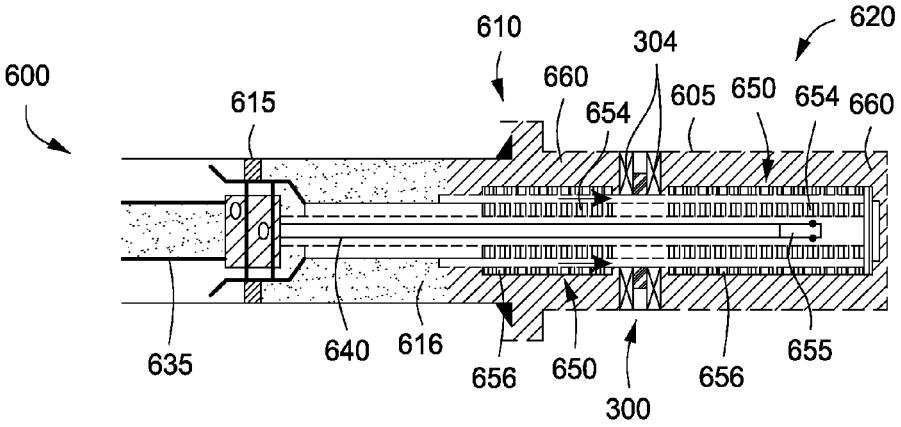

In FIG. 6L, the gravel pack 660 is beginning to form below the packer assembly 300 and around the sand screen 656. In FIG. 6M, the gravel pack 660 continues to grow from the bottom of the wellbore 600 up toward the packer assembly 300. In FIG. 6N, the gravel pack 660 has been formed from the bottom of the wellbore 600 up to the packer assembly 300. The sand screen 656 below the packer assembly 300 has been covered by gravel pack 660. The surface treating pressure increases to indicate that the annular space between the sand screens 656 and the wall 605 of the wellbore 600 is fully gravel packed.

Figure 6O:
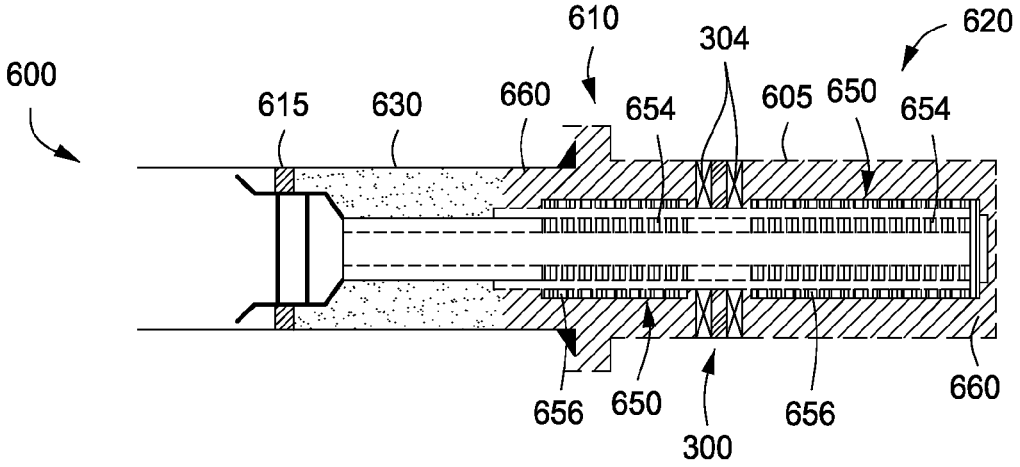

FIG. 6O shows the drill string 635 and the washpipe 640 from FIGS. 6A through 6N having been removed from the wellbore 600. The casing 630, the base pipes 654, and the sand screens 656 remain in the wellbore 600 along the upper 610 and lower 620 production intervals. Packer assembly 300 and the gravel packs 660 remain set in the open hole wellbore 600 following completion of the gravel packing procedure from FIGS. 6A through 6N. The wellbore 600 is now ready for production operations.

As mentioned above, once a wellbore has undergone gravel packing, the operator may choose to isolate a selected interval in the wellbore, and discontinue production from that interval. To demonstrate how a wellbore interval may be isolated, FIGS. 7A and 7B are provided.

Figure 7A:
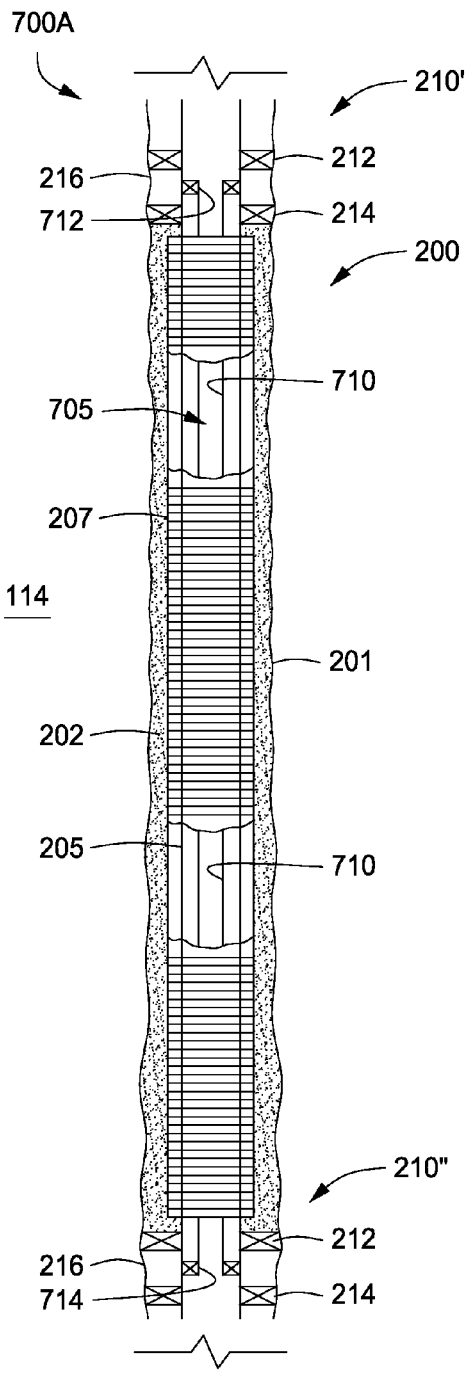
FIG. 7A is a cross-sectional view of a middle interval of the open-hole completion of FIG. 2. Here, a straddle packer has been placed within a sand control device across the middle interval to prevent the inflow of formation fluids.
Figure 7B:
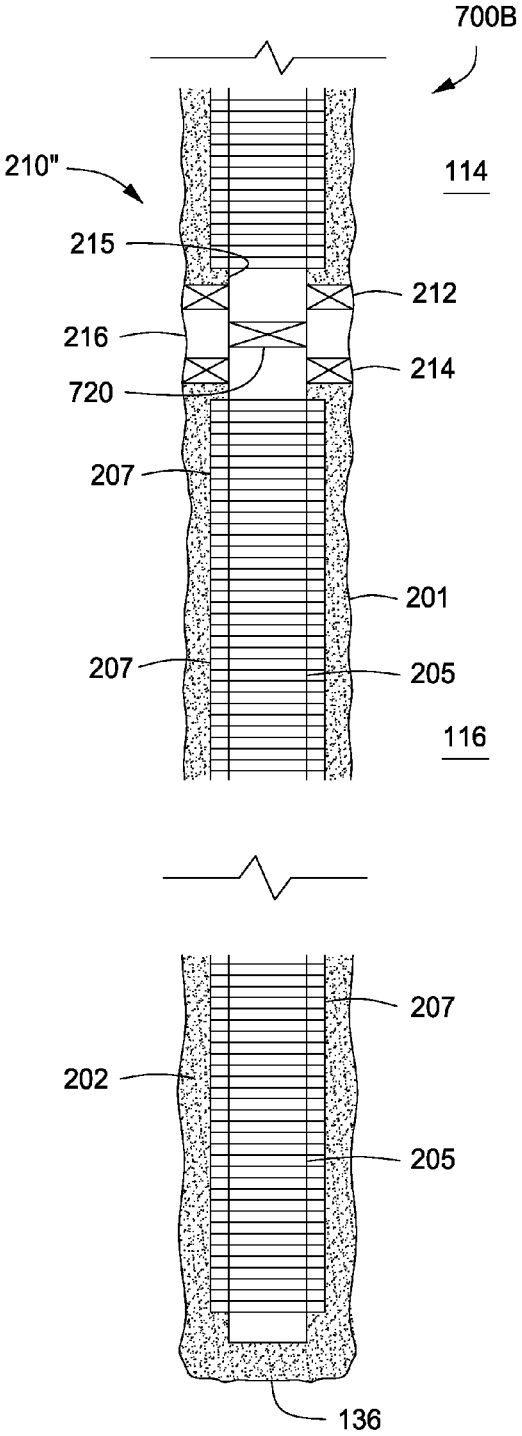
FIG. 7B is a cross-sectional view of middle and lower intervals of the open-hole completion of FIG. 2. Here, a plug has been placed within a packer assembly between the middle and lower intervals to prevent the flow of formation fluids up the wellbore from the lower interval.

First, FIG. 7A is a cross-sectional view of a wellbore 700A. The wellbore 700A is generally constructed in accordance with wellbore 100 of FIG. 2. In FIG. 7A, the wellbore 700A is shown intersecting through a subsurface interval 114. Interval 114 represents an intermediate interval. This means that there is also an upper interval 112 and a lower interval 116 (seen in FIG. 2, but not shown in FIG. 7A).

The subsurface interval 114 may be a portion of a subsurface formation that once produced hydrocarbons in commercially viable quantities but has now suffered significant water or hydrocarbon gas encroachment. Alternatively, the subsurface interval 114 may be a formation that was originally a water zone or aquitard or is otherwise substantially saturated with aqueous fluid. In either instance, the operator has decided to seal off the influx of formation fluids from interval 114 into the wellbore 700A.

A sand screen 200 has been placed in the wellbore 700A. Sand screen 200 is in accordance with the sand control device 200 of FIG. 2. In addition, a base pipe 205 is seen extending through the intermediate interval 114. The base pipe 205 is part of the sand screen 200. The sand screen 200 also includes a mesh screen, a wire-wrapped screen, or other circumferential filter medium 207. The base pipe 205 and surrounding filter medium 207 preferably comprise a series of joints connected end-to-end. The joints are ideally about 5 to 45 feet in length.

The wellbore 700A has an upper packer assembly 210' and a lower packer assembly 210". The upper packer assembly 210' is disposed near the interface of the upper interval 112 and the intermediate interval 114, while the lower packer assembly 210" is disposed near the interface of the intermediate interval 114 and the lower interval 116. Each packer assembly 210', 210" is preferably in accordance with packer assembly 300 of FIGS. 3A and 3B. In this respect, the packer assemblies 210', 210" will each have opposing mechanically-set packers 304. The mechanically-set packers are shown in FIG. 7A at 212 and 214. Each of the mechanically-set packers 212, 214 may be in accordance with the packers described in of U.S. Prov. Pat. Appl. No. 61/424,427. The packers 212, 214 are spaced apart as shown by spacing 216.

The wellbore 700A is completed as an open-hole completion. A gravel pack has been placed in the wellbore 700A to help guard against the inflow of granular particles. Gravel packing is indicated as spackles in the annulus 202 between the filter media 207 of the sand screen 200 and the surrounding wall 201 of the wellbore 700A.

In the arrangement of FIG. 7A, the operator desires to continue producing formation fluids from upper 112 and lower 116 intervals while sealing off intermediate interval 114. The upper 112 and lower 116 intervals are formed from sand or other rock matrix that is permeable to fluid flow. Alternatively, the operator desires to discontinue injecting fluids into the intermediate interval 114. To accomplish this, a straddle packer 705 has been placed within the sand screen 200. The straddle packer 705 is placed substantially across the intermediate interval 114 to prevent the inflow of formation fluids from (or the injection of fluids into) the intermediate interval 114.

The straddle packer 705 comprises a mandrel 710. The mandrel 710 is an elongated tubular body having an upper end adjacent the upper packer assembly 210', and a lower end adjacent the lower packer assembly 210". The straddle packer 700 also comprises a pair of annular packers. These represent an upper packer 712 adjacent the upper packer assembly 210', and a lower packer 714 adjacent the lower packer assembly 210". The novel combination of the upper packer assembly 210' with the upper packer 712, and the lower packer assembly 210" with the lower packer 714 allows the operator to successfully isolate a subsurface interval such as intermediate interval 114 in an open-hole completion.

Another technique for isolating an interval along an open-hole formation is shown in FIG. 7B. FIG. 7B is a side view of a wellbore 700B. Wellbore 700B may again be in accordance with wellbore 100 of FIG. 2. Here, the lower interval 116 of the open-hole completion is shown. The lower interval 116 extends essentially to the bottom 136 of the wellbore 700B and is the lowermost zone of interest.

In this instance, the subsurface interval 116 may be a portion of a subsurface formation that once produced hydrocarbons in commercially viable quantities but has now suffered significant water or hydrocarbon gas encroachment. Alternatively, the subsurface interval 116 may be a formation that was originally a water zone or aquitard or is otherwise substantially saturated with aqueous fluid. In either instance, the operator has decided to seal off the influx of formation fluids from the lower interval 116 into the wellbore 700B.

Alternatively, the operator may wish to no longer inject fluids into the lower interval 116. In this instance, the operator may again seal off the lower interval 116 from the wellbore 700B.

To accomplish this, a plug 720 has been placed within the wellbore 700B. Specifically, the plug 720 has been set in the mandrel 215 supporting the lower packer assembly 210". Of the two packer assemblies 210', 210", only the lower packer assembly 210" is seen. By positioning the plug 720 adjacent the lower packer assembly 210", the plug 720 is able to prevent the flow of formation fluids up the wellbore 700B from the lower interval 116, or down from the wellbore 700B into the lower interval 116.

It is noted that in connection with the arrangement of FIG. 7B, the intermediate interval 114 may comprise a shale or other rock matrix that is substantially impermeable to fluid flow. In this situation, the plug 720 need not be placed adjacent the lower packer assembly 210"; instead, the plug 720 may be placed anywhere above the lower interval 116 and along the intermediate interval 114. Further, in this instance the upper packer assembly 210' need not be positioned at the top of the intermediate interval 114; instead, the upper packer assembly 210' may also be placed anywhere along the intermediate interval 114. If the intermediate interval 114 is comprised of unproductive shale, the operator may choose to place blank pipe across this region, with alternate flow channels, i.e. transport tubes, along the intermediate interval 114.

The arrangements of FIGS. 7A and 7B provide one means for isolating selected formations. However, any modification of the inflow control arrangements of FIGS. 7A and 7B will require a removal of downhole equipment, that is, the straddle packer 705 or the plug 720. This may be technical difficult or expensive. Therefore, it is desirable to isolate different subsurface intervals along a sand control device using a traditional inflow control device having downhole valves that may be controlled from the surface. In this way, the operator may selectively produce formation fluids from or inject fluids into a selected subsurface interval very quickly. Stated another way, once a wellbore has undergone gravel packing, the operator may choose to isolate a selected interval in the wellbore, and discontinue production from that interval. To demonstrate how a wellbore interval may be isolated, FIG. 8 is provided.

Figure 8:
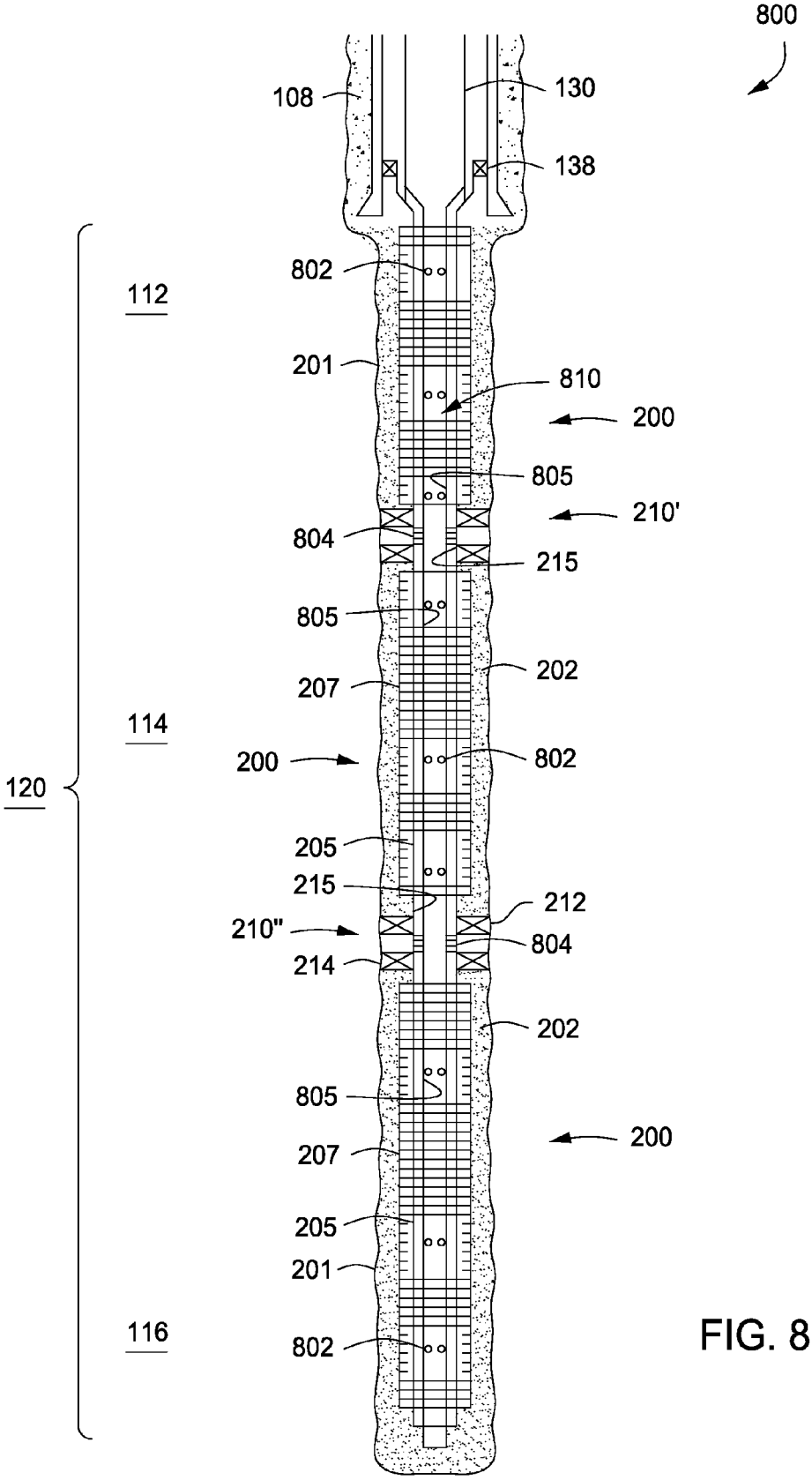
FIG. 8 is a side, schematic view of a wellbore having an isolation string of the present invention, in one embodiment, placed therein.

FIG. 8 is a side, schematic view of a wellbore 800. The wellbore 800 is generally formed in accordance with wellbore 100 of FIG. 2. In this respect, the wellbore 800 has a wellbore wall 201 formed to pass through an open-hole portion 120. The open-hole portion 120 includes illustrative subsurface intervals 112, 114, 116.

Sand control devices 200 have been placed along the open-hole portion 120 of the wellbore 800. The sand control devices 200 include base pipes 205 and filter media 207. In addition, an upper packer assembly 210' and a lower packer assembly 210" have been placed between joints of the base pipes 205. As described above, the packer assemblies 210', 210" are uniquely configured to seal the annular region 202 between the various sand control devices 200 and the surrounding wall 201 of the wellbore 800.

In order to control the flow of fluids between the wellbore 800 and the various subsurface intervals 112, 114, 116, an isolation string 810 is provided. The isolation string 810 includes a series of inflow control valves 802 along its length. Portions of the filter media or sand screen 207 are cut away to expose the valves 802. At least one of the valves 802 is placed above the upper packer assembly 210'; at least one of the valves 802 is placed below the lower packer assembly 210"; and at least one of the valves 802 is placed intermediate the upper 210' and lower 210" packer assemblies.

The isolation string 810 is preferably comprised of a series of tubular joints 805 threadedly connected end-to-end. The tubular joints 805 form a tubular body having an inner diameter defining a bore in fluid communication with a bore of a string of tubing 130. The tubular joints 805 also have an outer diameter configured to reside within the base pipe 205 of the sand control devices 200 and within the mandrel 215 of packer assemblies 210.

Some of the joints 805 will contain flow control valves 802. The flow control valves 802 represent one or more through-openings provided through the tubular joints 805. The valves 802 are controlled from the surface so that valves 802 may be selectively opened and closed. The valves 802 may be opened or closed in response to a mechanical force, in response to an electrical signal, in response to an acoustic signal, in response to the passing of a radio frequency identification (RFID) tag, or in response to fluid pressure provided through hydraulic lines.

In one embodiment, the functionality of the isolation string 810 may be facilitated by incorporating certain a commercially available products. These may include Halliburton's DuraSleeve® or Halliburton's Slimline Sliding Side-Door® (SSD). These may alternatively include Tendeka's Reflo™ or FloRight™. In one embodiment, and as shown in FIG. 8, multiple flow control valves 802 may be placed along each subsurface interval 112, 114, 116. All, or only a portion of, the flow control valves 802 along a selected interval may be closed in order to control the inflow of formation fluids into the wellbore 800. Reciprocally, all, or only a portion of, the flow control valves 802 along a selected interval may be opened in order to control the injection of fluids into an interval.

Figure 9A:
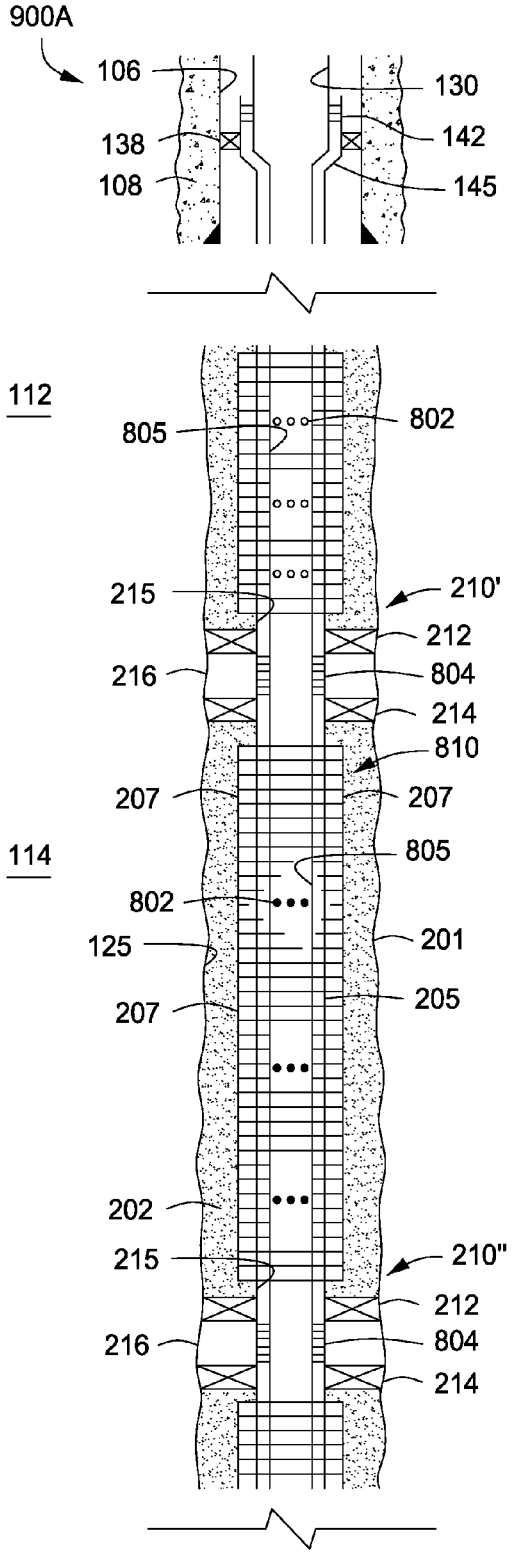
FIG. 9A is another cross-sectional view of a middle interval of the open-hole completion of FIG. 2. Here, a zonal isolation string has been placed within a sand control device along the middle interval, with the valves closed to prevent the inflow of formation fluids from the middle interval.
Figure 9B:
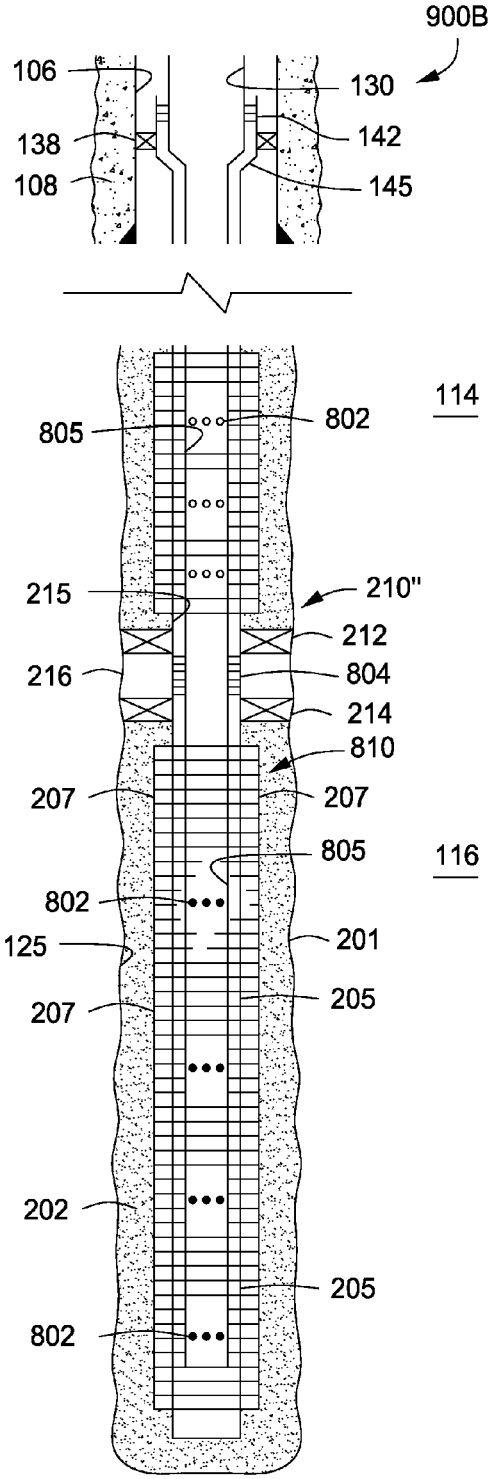
FIG. 9B is a cross-sectional view of middle and lower intervals of the open-hole completion of FIG. 2. Here, a zonal isolation string has been placed within a sand control device along the middle and lower intervals, with the valves closed to prevent the flow of formation fluids up the wellbore from the lower interval.

FIGS. 9A and 9B demonstrate the isolation of selected subsurface zones using the isolation string 810. FIGS. 9A and 9B generally replicate FIGS. 7A and 7B, except that an isolation string 810 is deployed in the wellbores rather than a straddle packer or a bridge plug. The isolation string 810 is hung from a latching seal device 142 and a polished bore receptacle (PBR) pinned by the production tubing 130, while the uppermost base pipe 205 of the sand control devices 200 is hung in the wellbores from a production packer 138 sealing the annular region to the casing string 106. The tubular joint 805 of the isolation string can be enlarged in diameter (shown in the area near 145) before connected to production tubing 130. Flow control valves 802 (not shown) can also be placed within the section of larger diameter tubing (shown in the area near 145) to increase the flow capacity from the upper isolated interval 112.

First, FIG. 9A is a cross-sectional view of a wellbore 900A. The wellbore 900A is generally constructed in accordance with wellbore 100 of FIG. 2. Further, the wellbore 900A is generally constructed in accordance with wellbore 700A of FIG. 7A. Therefore, details about the wellbore 900A will not be repeated, except to note that an isolation string 810 has been run into the base pipes 205 of the sand control devices 200. Also, portions of the filter media or sand screen 207 are again cut away to expose the valves 802.

In FIG. 9A, the wellbore 900A is shown intersecting through a subsurface interval 114. Interval 114 represents an intermediate interval. This means that there is also an upper interval 112 and a lower interval 116 (seen in FIG. 2, but not shown in FIG. 9A).

As with wellbore 700A, wellbore 900A is constructed to isolate the intermediate interval 114 from the base pipes 205. To accomplish this, the flow control valves 802 along the intermediate interval 114 have been closed. In addition, seals 804 have been set along the upper packer assembly 210' and the lower packer assembly 210". At the same time, flow control valves 802 remain open along the upper interval 112 (partially shown) and the lower interval 116 (not shown). In this way, the operator may continue to produce formation fluids from (or inject fluids into) the upper 112 and lower 116 intervals while sealing off intermediate interval 114.

Second, FIG. 9B is a cross-sectional view of a wellbore 900B. The wellbore 900B is also generally constructed in accordance with wellbore 100 of FIG. 2. Further, the wellbore 900B is generally constructed in accordance with wellbore 700B of FIG. 7B. Therefore, details about the wellbore 900B will not be repeated, except to note that an isolation string 810 has been run into the base pipes 205 of the sand control devices 200.

In FIG. 9B, the wellbore 900B is constructed to isolate the lower interval 116 from the base pipes 205. The lower interval 116 extends essentially to the bottom 136 of the wellbore 900B and is the lowermost zone of interest. To accomplish this, the flow control valves 802 along the lower interval 116 have been closed. In addition, seals 804 have been set along the lower packer assembly 210". At the same time, flow control valves 802 remain open along the upper interval 112 (not shown) and the intermediate interval 114 (partially shown). In this way, the operator may continue to produce formation fluids from (or inject fluids into) the upper 112 and intermediate 114 intervals while sealing off the lower interval 116.

It is noted for wellbores 900A and 900B that, in lieu of completely shutting off all of the valves 802 in the intermediate 114 or in the lower 116 subsurface intervals, the operator may alternatively choose to only close part of the valves associated with one interval. Alternatively, the operator may choose to only partially close some or all of the valves associated with one interval.

It is also noted for wellbores 900A and 900B that multiple through-openings or flow ports are depicted for the valves 802. However, the flow control device associated with opening and closing of valves 802 along one zone may be only one device, such that all through-openings indicated by reference number 802 are technically one valve, or possibly only two valves.

Figure 10:
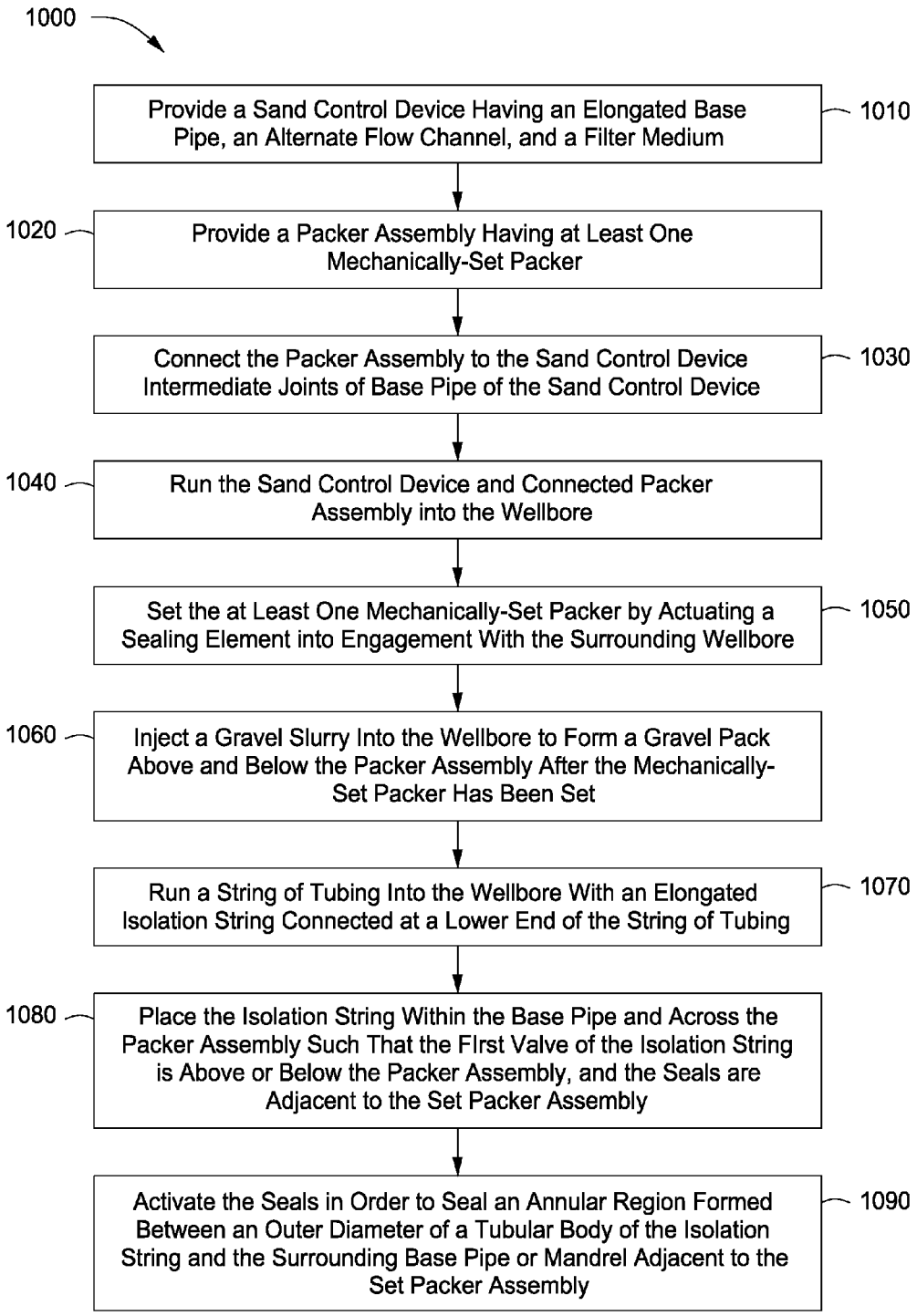
FIG. 10 is a flowchart for a method of completing a wellbore, in one embodiment. The method involves running a sand control device and packer assembly into a wellbore, setting a packer, installing a gravel pack in the wellbore, and running a zonal isolation string into the sand control device.

Based on the above descriptions, a method for completing an open-hole wellbore is provided herein. The method is presented in FIG. 10. FIG. 10 provides a flow chart presenting steps for a method 1000 of completing a wellbore, in various embodiments.

The method 1000 first includes providing a sand control device. This is shown at Box 1010. The sand control device may be in accordance with the sand control devices 200 of FIG. 2. In this respect, the sand control device generally includes an elongated base pipe having at least two joints, at least one alternate flow channel extending substantially along the base pipe, and a filter medium radially surrounding the base pipe along a substantial portion of the base pipe. In this way a sand screen is formed.

The method 1000 also includes providing a packer assembly. This is provided at Box 1020. The packer assembly has at least one mechanically-set packer, such as the packer described in U.S. Prov. Pat. Appl. No. 61/424,427, or a swellable packer. Thus, the packer generally has a sealing element, an inner mandrel, and at least one alternate flow channel in fluid communication with the at least one alternate flow channel in the sand control device.

The method 1000 further includes connecting the packer assembly to the sand screen intermediate the at least two joints. This is indicated at Box 1030. The method then includes running the packer assembly and connected sand screen into the wellbore. This is provided at Box 1040. The packer and connected sand screen are placed along the open-hole portion (or other production interval) of the wellbore.

The method 1000 also includes setting the at least one mechanically-set packer. This is seen in Box 1050. The setting step of Box 1050 is done by actuating the sealing element of the packer into engagement with the surrounding open-hole portion of the wellbore. Thereafter, the method 1000 includes injecting a gravel slurry into an annular region formed between the sand screen and the surrounding open-hole portion of the wellbore, and then further injecting the gravel slurry through the alternate flow channels. This is shown at Box 1060.

The flow channels allow the gravel slurry to bypass the packer. In this way, the open-hole portion of the wellbore is gravel-packed above and below the packer after the packer has been set in the wellbore. Notably, the flow channels also allow the gravel slurry to bypass any premature sand bridges and areas of borehole collapse.

The flow channels may be circular shunt tubes located inside of a sand screen. Optionally, the flow channels may be rectangular shunt tubes eccentrically attached to the outside of a sand screen. An example of such a shunt tube arrangement is found in Schlumberger's OptiPac™ sand screen. Where an external eccentric arrangement is employed, a separate cross-over tool (not shown) would be required for connection with a concentric internal shunt open-hole packer.

In the method 1000, it is preferred that the packer assembly also includes a second mechanically-set packer. The second mechanically-set packer is constructed in accordance with the first mechanically-set packer, or may be substantially a mirror image thereof. A swellable packer may then optionally be provided intermediate the first and second mechanically-set packers. The swellable packer has alternate flow channels aligned with the alternate flow channels of the first and second mechanically-set packers. An example of a swellable packer arrangement is disclosed in WIPO Publ. No. 2011/062669 entitled "Open-Hole Packer for Alternate Path Gravel Packing, and Method for Completing an Open-Hole Wellbore." Alternatively, the packer assembly may include a gravel-based zonal isolation tool, meaning that gravel is packed around an elongated blank pipe. An example of a gravel-based zonal isolation tool is described in WO Pat. Publ. No. 2010/120419 entitled "Systems and Methods for Providing Zonal Isolation in Wells."

In one aspect, each mechanically-set packer will have an inner mandrel, and alternate flow channels around the inner mandrel. The packers may further have a movable piston housing and an elastomeric sealing element. The sealing element is operatively connected to the piston housing. This means that sliding the movable piston housing along each packer (relative to the inner mandrel) will actuate the respective sealing elements into engagement with the surrounding wellbore.

The method 1000 may further include running a setting tool into the inner mandrel of the packers, and releasing the movable piston housing in each packer from its fixed position. Preferably, the setting tool is part of or is run in with a washpipe used for gravel packing. The step of releasing the movable piston housing from its fixed position then comprises pulling the washpipe with the setting tool along the inner mandrel of each packer. This serves to shear the at least one shear pin and shift the release sleeves in the respective packers. Shearing the shear pin allows the piston housing to slide along the piston mandrel and exert a force that sets the elastomeric packer elements.

The method 1000 also includes running a string of tubing into the wellbore with an elongated isolation string connected at a lower end of the string of tubing. This is shown at Box 1070 of FIG. 10. The isolation string generally comprises a tubular body having an inner diameter defining a bore in fluid communication with a bore of the string of tubing, and an outer diameter configured to reside within the base pipe of the sand control device and the mandrel of the packer assembly. The isolation string further has a first valve, and one or more seals along the outer diameter of the tubular body.

The first valve may be a single through-opening. More preferably, the first valve comprises a set of through-openings or flow ports provided along a selected subsurface interval. The valve may operate to completely open or only partially open the through-openings. Alternatively, the valve may operate to open some but not all through-openings along a selected interval.

The method 1000 then includes placing the elongated isolation string within the base pipe of the sand control device, and across the packer assembly. This is seen in Box 1080 of FIG. 10. In this way, the first valve of the isolation string is above or below the packer assembly, and the seals of the isolation string are adjacent to the set packer assembly.

The isolation string is preferably run with the production tubing string after the mechanically-set packers have been set, after the well has been gravel-packed, and after the washpipe and attached setting tool have been pulled to the surface. Preferably, an open-hole portion of the wellbore is swept with a gravel pack gel or the drilling mud is conditioned before the mechanically-set packers are set.

The isolation string is run into the wellbore below a polished bore receptacle and a latching device. The polished bore receptacle is pinned to the tubing string while running into the wellbore. The latching device is used to hold the polished bore receptacle in position above a gravel pack packer and/or a production packer, but will have a shear-out feature. In addition, a packer may be set above the sand screens to isolate the annulus around the production tubing from the lower wellbore. A ratching muleshoe may be located on the bottom of the isolation string to assist in entering the top of the sand control device.

The method 1000 further includes activating the seals in order to seal an annular region formed between the outer diameter of the tubular body and the surrounding mandrel adjacent to the set packer assembly. This is provided in Box 1090. Activating the seals allows an operator to hydraulically isolate each of multiple zones or combinations of zones from each other. The seals may be o-ring seals fabricated from. Alternatively, the seals may be an inflatable packer, a cup-type packer, a mechanical packer, or a swellable packer. In one embodiment, six Viton/Teflon/Ryton ("VTR") seal stacks are wrapped around an 18" mandrel for a total length of 9 feet.

It is preferred that the first valve comprise two or more through-openings through the tubular body. In this instance, the method further includes closing at least one of the two or more through-openings, thereby restricting the flow of fluids through the tubular body. It is also preferred that the isolation string include a second valve. In this instance, either the first valve or the second valve is above the packer, and the other of the first valve and the second valve is below the packer. In this instance, the method further includes closing the first valve, the second valve, or both, or alternatively, opening the first valve, the second valve, or both, thereby creating fluid communication between the selected valve and a bore of the base pipe.

A common flow control uses sliding sleeves operated by a shifting tool, electrical lines, or hydraulic lines. Optionally, a wireless arrangement may be employed, such as through acoustic signals or radio frequency identification (RFID) tags. Optionally still, a pressure threshold system may be provided for the valves. For purposes of the present disclosure, the term "valve" includes through-openings or sliding sleeves operated by any of these means.

Benefits of the above method in its various embodiments include production or injection allocation among zones, water/gas shut-off, selective stimulation, delayed production from selective zones, delayed injection into selective zones, or preventing or mitigating cross-flow between selected zones. When combined with downhole multi-phase flow rate measurement or other downhole pressure, temperature, density, tracer, or strain sensors, the subsurface control becomes more quantitative in analyzing production data.

It is noted that if any zone is intended to be a non-producing zone or a non-injecting zone, no valve or no through-openings need be placed along such a zone. Instead, a blank section of pipe may be provided. The blank pipe will be equipped with transport tubes as flow channels, but need not have packing tubes. In this instance, the wellbore annulus need not be gravel packed over the isolated interval.

The above method 1000 may be used to selectively produce from or inject into multiple zones. This provides enhanced subsurface production or injection control in a multi-zone completion wellbore.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off one or more selected subsurface intervals. An improved zonal isolation apparatus is also provided. The inventions permit an operator to produce fluids from or to inject fluids into a selected subsurface interval.

What is claimed is:

1. A method for completing a wellbore in a subsurface formation, the method comprising:

providing a sand control device comprising:

an elongated base pipe having at least two joints, at least one alternate flow channel extending substantially along the base pipe, and a filter medium radially surrounding the base pipe along a substantial portion of the base pipe so as to form a sand screen;

providing a packer assembly comprising at least one mechanically-set packer, each mechanically-set packer comprising:

a sealing element, an inner mandrel, and at least one alternate flow channel;

connecting the packer assembly to the sand screen intermediate the at least two joints so that the at least one alternate flow channel in the packer assembly is in fluid communication with the at least one alternate flow channel in the sand control device;

running the sand control device and connected packer assembly into the wellbore;

setting the at least one mechanically-set packer by actuating the sealing element into engagement with the surrounding wellbore;

injecting a gravel slurry into the wellbore in order to form a gravel pack above and below the packer assembly after the at least one mechanically-set packer has been set;

running a string of tubing into the wellbore with an elongated isolation string connected at a lower end of the string of tubing, the isolation string comprising:

a tubular body having an inner diameter defining a bore in fluid communication with a bore of the string of tubing, and an outer diameter configured to be received within the base pipe and the inner mandrel, a first valve providing fluid communication between the bore of tubular body and an annular region formed between the outer diameter of the tubular body and the surrounding base pipe, and one or more seals along the outer diameter of the tubular body;

placing the elongated isolation string within the base pipe and across the packer assembly such that:

the first valve is above or below the packer assembly, and the one or more seals is adjacent to the set packer assembly; and activating the one or more seals in order to seal an annular region formed between the outer diameter of the tubular body and the surrounding inner mandrel adjacent to a set packer.

2. The method of claim 1, wherein the first valve comprises at least one through-opening through the tubular body, and the method further comprises:

closing at least one of the at least one through-opening, thereby partially restricting the flow of fluids through the tubular body along a selected zone.

3. The method of claim 1, wherein closing at least one of the at least one through-opening is in response to (i) a mechanical force applied to the first valve, (ii) an electrical signal sent to the first valve, (iii) an acoustic signal delivered to the first valve, (iv) the passing of a radio frequency identification (RFID) tag across the first valve, or (v) hydraulic pressure provided to the first valve.

4. The method of claim 1, wherein the isolation string further comprises a second valve, and wherein:

either the first valve or the second valve is above the packer; and the other of the first valve or the second valve is below the packer.

5. The method of claim 4, further comprising:

closing the first valve, the second valve, or both.

6. The method of claim 4, further comprising:

opening the first valve, the second valve, or both, thereby creating fluid communication between the selected valve and a bore of the base pipe.

7. The method of claim 1, wherein the filtering medium of the sand screen comprises a wire-wrapped screen, a membrane screen, an expandable screen, a sintered metal screen, a wire-mesh screen, a shape memory polymer, or a pre-packed solid particle bed.

8. The method of claim 1, wherein:

the wellbore is completed with a string of perforated casing; and actuating the sealing elements of the at least one packer assembly into engagement with the surrounding wellbore means actuating the sealing elements into engagement with the surrounding perforated casing.

9. The method of claim 1, wherein:

the wellbore is completed with a section of non-perforated casing; and actuating the sealing elements of the at least one packer assembly into engagement with the surrounding wellbore means actuating the sealing elements into engagement with the surrounding non-perforated casing.

10. The method of claim 1, wherein:

the wellbore is completed as an open-hole completion; and actuating the sealing elements of the at least one packer assembly into engagement with the surrounding wellbore means actuating the sealing elements into engagement with a surrounding subsurface formation.

11. The method of claim 1, wherein each of the at least one mechanically-set packer further comprises:

a movable piston housing retained around the inner mandrel; and one or more flow ports providing fluid communication between the alternate flow channels and a pressure-bearing surface of the piston housing.

12. The method of claim 11, further comprising:

running a setting tool into the inner mandrel of the at least one mechanically-set packer before running the elongated isolation string into the sand control device;

manipulating the setting tool to mechanically release the movable piston housing from its retained position; and communicating hydrostatic pressure to the piston housing through the one or more flow ports, thereby moving the released piston housing and actuating the sealing element against the surrounding wellbore.

13. The method of claim 11, wherein:

each of the at least one mechanically-set packer comprises a first mechanically-set packer and a second mechanically-set packer spaced apart from the first mechanically-set packer, the second mechanically-set packer being substantially a mirror image of or substantially identical to the first mechanically-set packer.

14. The method of claim 13, further comprising:

running a setting tool into the inner mandrel of each of the first and second packers before running the elongated isolation string into the sand control device;

manipulating the setting tool to mechanically release the movable piston housing from its retained position along each of the respective first and second packers; and communicating hydrostatic pressure to the piston housings through the one or more flow ports, thereby moving the released piston housings and actuating the sealing element of each of the first and second packers against the surrounding wellbore.

15. The method of claim 13, wherein the packer assembly further comprises a swellable packer element intermediate the first mechanically-set packer and the second mechanically-set packer.

16. The method of claim 1, wherein the packer assembly further comprises:

a section of blank pipe intermediate the first mechanically-set packer and the second mechanically-set packer; and placing a gravel pack around the section of blank pipe.

17. The method of claim 16, wherein the gravel pack is between about 40 feet (12.19 meters) and 100 feet (30.48 meters) in length.

18. The method of claim 1, further comprising:

conditioning a column of drilling mud residing in the wellbore before running the sand control device and connected packer assembly into the wellbore.

19. The method of claim 1, further comprising:

producing hydrocarbon fluids from the subsurface formation and through the base pipe of the sand control device.

20. The method of claim 1, further comprising:

injecting fluids into the base pipe of the sand control device and into the subsurface formation.

21. The method of claim 13, wherein the isolation string further comprises a second valve, and wherein:

the first valve is above the first packer assembly;

the second valve is intermediate the first and second packer assemblies; and the third valve is below the second packer assembly.

22. A gravel pack zonal isolation apparatus, comprising:

a string of tubing comprising an inner bore for receiving fluids;

a sand control device comprising:

an elongated base pipe extending from a first end to a second end, at least one alternate flow channel along the base pipe extending from the first to the second end, and a filter medium radially surrounding the base pipe along a substantial portion of the base pipe so as to form a sand screen;

a first packer assembly disposed along the sand control device, the packer assembly comprising an upper mechanically-set packer having:

a sealing element, an inner mandrel, and at least one alternate flow channel in fluid communication with the at least one alternate flow channel in the sand control device to divert gravel pack slurry past the upper mechanically-set packer during a gravel-packing operation; and an elongated isolation string traversing across the packer assembly and at least a portion of the sand control device, the isolation string comprising:

a tubular body having an inner diameter defining a bore in fluid communication with the string of tubing, and an outer diameter configured to be received within the base pipe and the inner mandrel, a first valve above or below the packer assembly, the first valve defining at least one flow port that may be opened and closed in order to selectively place the bore of the tubular body in fluid communication with a bore of the base pipe, and one or more seals along the outer diameter of the tubular body, the one or more seals being adjacent to the packer assembly and sealing an annular region formed between the outer diameter of the tubular body and the surrounding inner mandrel.

23. The zonal isolation apparatus of claim 22, wherein the first valve is configured to close the at least one flow port in response to (i) a mechanical force applied to the first valve, (ii) an electrical signal sent to the first valve, (iii) an acoustic signal delivered to the first valve, (iv) the passing of a radio frequency identification (RFID) tag across the first valve, or (v) hydraulic pressure provided to the first valve.

24. The zonal isolation apparatus of claim 22, wherein the isolation string further comprises a second valve, and wherein:

either the first valve or the second valve is above the first packer assembly; and the other of the first valve or the second valve is below the first packer assembly.

25. The zonal isolation apparatus of claim 24, wherein:

each of the first valve and the second valve is configured so that at least one of the at least one flow port may be selectively closed, thereby partially restricting the flow of fluids through the tubular body.

26. The zonal isolation apparatus of claim 22, wherein the filter medium for the sand screen comprises a wire-wrapped screen, a membrane screen, an expandable screen, a sintered metal screen, a wire-mesh screen, a shape memory polymer, or a pre-packed solid particle bed.

27. The zonal isolation apparatus of claim 22, wherein the packer assembly further comprises:

a lower mechanically-set packer also having:

a sealing element, an inner mandrel, and at least one alternate flow channel in fluid communication with the at least one alternate flow channel in the sand control device to divert gravel pack slurry past the lower mechanically-set packer during a gravel-packing operation.

28. The zonal isolation apparatus of claim 27, further comprising:

a swellable packer intermediate the upper mechanically-set packer and the lower mechanically-set packer, the swellable packer having an element that swells over time in the presence of a fluid; and wherein the swellable packer comprises at least one alternate flow channel in fluid communication with the at least one alternate flow channel in the upper mechanically-set packer and the lower mechanically-set packer to divert gravel pack slurry past the upper mechanically-set packer, the swellable packer, and the lower mechanically-set packer during a gravel-packing operation.

29. The zonal isolation apparatus of claim 28, wherein the swellable packer element is at least partially fabricated from an elastomeric material.

30. The zonal isolation apparatus of claim 29, wherein the swellable elastomeric packer element comprises a material that swells (i) in the presence of an aqueous liquid, (ii) in the presence of a hydrocarbon liquid, (iii) in the presence of an actuating chemical, or (iv) combinations thereof.

31. The zonal isolation apparatus of claim 27, wherein each of the upper and lower packers further comprises:

a movable piston housing retained around the inner mandrel, one or more flow ports providing fluid communication between the alternate flow channels and a pressure-bearing surface of the piston housing, and a release sleeve along an inner surface of the inner mandrel, the release sleeve being configured to move in response to movement of a setting tool within the inner mandrel and thereby expose the one or more flow ports to hydrostatic pressure during the gravel-packing operation.

32. The zonal isolation apparatus of claim 27, wherein the elongated base pipe comprises multiple joints of pipe connected end-to-end.

33. The zonal isolation apparatus of claim 32, wherein the lower mechanically-set packer is arranged within the packer assembly as substantially a mirror image of the upper mechanically-set packer.

34. The zonal isolation apparatus of claim 22, further comprising:

a second packer assembly disposed along the sand control device, wherein the first packer assembly and the second packer assembly substantially straddle a selected subsurface interval along a wellbore.

35. The zonal isolation apparatus of claim 34, wherein the isolation string further comprises a second valve, and wherein:

one of the first valve or the second valve is above the first packer assembly; and the other of the first valve and the second valve is below the first packer assembly.

36. The zonal isolation apparatus of claim 35, wherein the isolation string further comprises a third valve, and wherein:

the first valve is above the first packer assembly;

the second valve is intermediate the first and second packer assemblies; and the third valve is below the second packer assembly.

37. The zonal isolation apparatus claim 22, wherein:

the wellbore is completed with a string of perforated casing; and the first packer assembly is set within the surrounding perforated casing.

38. The zonal isolation apparatus of claim 22, wherein:

the wellbore is completed with a section of non-perforated casing; and the first packer assembly is set within the surrounding non-perforated casing.

39. The zonal isolation apparatus of claim 22, wherein:

the wellbore has a lower end defining an open-hole portion; and the first packer assembly is set within the open-hole portion.

40. The zonal isolation apparatus of claim 22, wherein the sand control device further comprises:

a load sleeve assembly having an elongated body comprising:

an outer tubular body, an inner tubular body within the outer tubular body, a bore within the inner tubular body, and at least one transport conduit and at least one packing conduit disposed in an annular region provided between the inner tubular body and the surrounding outer tubular body;

a torque sleeve assembly also having an elongated body comprising:

an outer tubular body, an inner tubular body within the outer tubular body, a bore within the inner tubular body, and at least one transport conduit disposed in an annular region provided between the inner tubular body and the surrounding outer tubular body;

wherein the load sleeve is operably attached to a joint of base pipe at a first end of the joint, and the torque sleeve assembly is operably attached to a joint of base pipe at a second opposite end of the joint.

* * * * *